US006548216B2

(12) United States Patent
Kawamura et al.

(10) Patent No.: US 6,548,216 B2
(45) Date of Patent: Apr. 15, 2003

(54) ELECTROPHOTOGRAPHIC PHOTOCONDUCTOR, IMAGE FORMING METHOD AND APPARATUS, AND PROCESS CARTRIDGE USING THE PHOTOCONDUCTOR, AND LONG-CHAIN ALKYL GROUP CONTAINING BISPHENOL COMPOUND AND POLYMER MADE THEREFROM

(75) Inventors: Shinichi Kawamura, Shizuoka (JP); Kazukiyo Nagai, Shizuoka (JP); Tomoyuki Shimada, Shizuoka (JP); Chiaki Tanaka, Shizuoki (JP); Michihiko Namba, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/814,722

(22) Filed: Mar. 23, 2001

(65) Prior Publication Data

US 2002/0025483 A1 Feb. 28, 2002

(30) Foreign Application Priority Data

| | | |
|---|---|---|
| Mar. 24, 2000 | (JP) | 2000-083304 |
| Oct. 24, 2000 | (JP) | 2000-323941 |
| Feb. 22, 2001 | (JP) | 2001-047310 |

(51) Int. Cl.[7] ..... G03G 5/05
(52) U.S. Cl. ..... 430/59.6; 430/96
(58) Field of Search ..... 430/96, 59.6, 58.05; 399/159

(56) References Cited

U.S. PATENT DOCUMENTS

| | | | | |
|---|---|---|---|---|
| 3,703,372 A | * | 11/1972 | Merrill | 430/96 |
| 4,784,928 A | * | 11/1988 | Kan et al. | 430/59.6 |
| 4,851,314 A | * | 7/1989 | Yoshihara | 430/96 |
| 6,165,662 A | * | 12/2000 | Kato et al. | 430/59.6 |
| 6,278,854 B1 | * | 8/2001 | Handa | 430/58.05 |

FOREIGN PATENT DOCUMENTS

JP 07013363 A * 1/1995

OTHER PUBLICATIONS

Diamond, Arthur S. (editor) Handbook of Imaging Materials. New York: Marcel–Dekker, Inc. pp. 160–162, 427,428.*
Chemical Abstracts 122:302964 (1995).*
U.S. patent application Ser. No. 09/897,924, filed Jul. 5, pending.
U.S. patent application Ser. No. 09/817,151, filed Mar. 27, pending.

* cited by examiner

*Primary Examiner*—Christopher Rodee
(74) *Attorney, Agent, or Firm*—Oblon, Spivak, McClelland, Maier & Neustadt, P.C.

(57) ABSTRACT

An electrophotographic photoconductor has an electroconductive support and a photoconductive layer which is formed thereon and contains at least one resin of a polyurethane resin, a polyester resin, or a polycarbonate resin, each resin having at least a structural unit of formula (1):

(1)

wherein $R^1$, $R^2$, $R^3$, a, b, and n are the same as those specified in the specification. An electrophotographic image forming apparatus and method, and a process cartridge employ the above photoconductor. A long-chain alkyl group containing bisphenol compound is represented by formula (2):

(2)

17 Claims, 2 Drawing Sheets

ELECTROPHOTOGRAPHIC PHOTOCONDUCTOR, IMAGE FORMING METHOD AND APPARATUS, AND PROCESS CARTRIDGE USING THE PHOTOCONDUCTOR, AND LONG-CHAIN ALKYL GROUP CONTAINING BISPHENOL COMPOUND AND POLYMER MADE THEREFROM

BACKGROUND OF THE INVENTION

1. Field of the Invention

The present invention relates to an electrophoto-graphic photoconductor comprising an electroconductive support and a photoconductive layer which is formed on the electroconductive support and contains a specific resin. In addition, the present invention relates to an electrophotographic image forming apparatus and method using the above-mentioned photoconductor, and a process cartridge including the photoconductor, which process cartridge is freely attachable to the image forming apparatus and detachable therefrom. The present invention also relates to a long-chain alkyl group containing bisphenol compound and a polymer made from the bisphenol compound, which is useful when used in an electrophoto-graphic photoconductor.

2. Discussion of Background

To achieve image formation by electrophotography, the surface of an electrophotographic photoconductor (hereinafter referred to as a photoconductor) is uniformly charged in the dark, for example, by corona charging, and exposed to light images to selectively dissipate electric charge of a light-exposed portion, thereby forming latent electrostatic images on the surface of the photoconductor. The latent electrostatic images are developed as visible toner images with a toner that is made up of a coloring agent, such as a dye or pigment, and a polymeric material. The toner images formed on the photoconductor are transferred to an image receiving member and fixed thereon. After the toner images are transferred to the image receiving member, residual toner on the surface of the photoconductor is removed therefrom, and the photoconductor is subjected to a quenching step. Image formation can thus be repeated, using the photoconductor, by the so-called Carlson process, for an extended period of time.

Photoconductive material for use in the above-mentioned photoconductor is roughly divided into an inorganic photoconductive material and an organic photoconductive material.

Most of the currently available photoconductors employ organic photoconductive materials. This is because an organic photoconductive material is superior to an inorganic material in terms of the degree of freedom in selection of wavelength of light to which the photoconductive material is sensitive, the filming forming properties, flexibility, transparency of the obtained film, mass productivity, toxicity, and cost.

The photoconductor repeatedly used in the electrophotographic process or the like is required to have basic electrostatic properties such as good sensitivity, sufficient charging potential, charge retention properties, stable charging characteristics, minimal residual potential, and excellent spectral sensitivity. In addition to the above, the photoconductor is also required to have satisfactory physical properties from the viewpoints of printing resistance, wear resistance, and moisture resistance.

In recent years, data processors employing the electrophotographic process have exhibited remarkable development. The image quality and printing reliability have noticeably improved, in particular, in the field of a printer that adapts a digital recording system by which information is converted into a digital signal and recorded by means of light. Such a digital recording system is applied to not only printers, but also to copying machines. Namely, a digital copying machine has been actively developed. Further, there is a tendency for the digital copying machine to be provided with various data processing functions, so that demand for the digital copying machine is expected to rise sharply.

A function-separation layered photoconductor has become the mainstream in the field of electrophotographic photoconductors for the above-mentioned digital copying machine. The function-separation layered photoconductor is constructed in such a manner that a charge generation layer is provided on an electroconductive support directly or via an undercoat layer, and a charge transport layer is further overlaid on the charge generation layer. To improve the durability of the photoconductor from the mechanical and chemical viewpoints, a protective layer may be overlaid on the top surface of the photoconductive layer.

When the surface of the function-separation layered photoconductor is charged and thereafter exposed to light images, the light passes through the charge transport layer and is absorbed by a charge generation material for use in the charge generation layer. Upon absorbing light, the charge generation material produces a charge carrier. The charge carrier is injected into the charge transport layer and travels along an electric field generated by the charging step to neutralize the surface charge of the photoconductor. As a result, latent electrostatic images are formed on the surface of the photoconductor.

In view of the above-mentioned mechanism of the function-separation layered photoconductor, a charge generation material which exhibits absorption peaks within the range from the near infrared region to the visible light region is often used in combination with a charge transport material that does not hinder the charge generation material from absorbing light, in other words, exhibiting absorption within the range from the visible light region (yellow light region) to the ultraviolet region.

As a light source capable of coping with the above-mentioned digital recording system, a semiconductor laser diode (LD) and a light emitting diode (LED), which are compact, inexpensive, and highly reliable, are widely employed. The LD most commonly used these days has an oscillation wavelength range in the near infrared region of around 780 to 800 nm. The emitting wavelength of the typical LED is located at 740 nm.

The beam spot size of the LD or LED is in the range of about 60 to 150 $\mu$m. Therefore, the resolution obtained by currently available electrophotographic image forming apparatus is about 300 to 600 dpi at most, which is not sufficient to produce a high-resolution image equivalent to a photograph. To narrow down the beam spot size to about 30 $\mu$m to increase the resolution to 1200 dpi, or to about 15 $\mu$m to increase the resolution to as high as 2400 dpi, extra optical parts of extremely high precision as well as bulky optical members become necessary. In light of cost and space in the apparatus, such an electrophoto-graphic image forming apparatus has not been put to practical use. Therefore, to produce images with a higher resolution to the extent stated above, shortening of the emitting wavelength of the employed light source has been considered effective. For instance, Japanese Laid-Open Patent Application 5-19598 discloses an electrophoto-graphic image forming apparatus employing a laser beam with a shorter wavelength.

Recently, an LD or LED with oscillation wavelengths of 400 to 450 nm to emit a violet or blue light has been developed and finally put on the market as a light source for writing information so as to cope with the digital recording system. This kind of LD or LED is hereinafter referred to as "shorter wavelength LD or LED." In the case where a shorter wavelength LD, of which the oscillation wavelength is as short as nearly half the conventional one located in the near infrared light region, is used as the light source for writing, it is theoretically possible to decrease the spot size of a laser beam projected on the surface of a photoconductor, in accordance with the following formula (A):

$$d \propto (\pi/4)(\lambda f/D) \quad \text{(A)}$$

wherein d is the spot size projected on the surface of the photoconductor, $\lambda$ is the wavelength of the laser beam, f is the focal length of a f$\theta$ lens, and D is the lens diameter.

Further, from the use of such a shorter wavelength LD or LED it will be possible to make the electrophoto-graphic image forming apparatus compact as a whole, and to speed up the electrophotographic image forming method. Accordingly, there is an increasing demand for high sensitivity and high stability of the electrophotographic photoconductor so as to cope with the light source of the LD or LED having wavelengths of about 400 to 450 nm.

As previously mentioned, the function-separation layered photoconductor has been the mainstream of the electrophotographic photoconductors. With such a layered structure, the charge transport layer is usually overlaid on the charge generation layer. High sensitivity can be obtained if light emitted from the shorter wavelength LD or LED can efficiently reach the charge generation layer after passing through the charge transport layer. Namely, it becomes important that the charge transport layer not absorb the light from the LD or LED.

The charge transport layer is generally a film with a thickness of about 10 to 30 $\mu$m made from a solid solution in which a low-molecular weight charge transport material is dispersed in a binder resin. Most of the currently available photoconductors employ as a binder resin for the charge transport layer a bisphenol polycarbonate resin or a copolymer of a monomer of the above-mentioned polycarbonate resin and any other monomers. According to the spectroscopic analysis, the bisphenol polycarbonate resin has the characteristics that no absorption appears in the wavelength range from 390 to 460 nm. Therefore, the bisphenol polycarbonate resin does not severely hinder the light for a recording operation from being transmitted through the charge transport layer.

The following are commercially available charge transport materials that are conventionally known: 1,1-bis(p-diethylaminophenyl)-4,4-diphenyl-1,3-butadiene (Japanese Laid-Open Patent Application 62-30255), 5-[4-(N,N-di-p-tolylamino)benzylidene]-SH-dibenzo[a,b]cycloheptene (Japanese Laid-Open Patent Application 63-225660), and pyrene-1-aldehyde 1,1-diphenylhydrazone (Japanese Laid-Open Patent Application 58-159536). These conventional charge transport materials exhibit absorption in the wavelength range of 390 to 460 nm. Therefore, the light emitted from the above-mentioned shorter wavelength LD or LED is unfavorably absorbed in a surface portion of the charge transport layer. As a result, the light cannot reach the charge generation layer, whereby the photosensitivity cannot be obtained in principle.

Japanese Laid-Open Patent Applications 55-67778 and 9-190054 state that when light with a particular wavelength which will be absorbed by the charge transport material is used, a decrease in charging characteristics and an increase in residual potential are caused during repeated operations. Light absorption by the charge transport material lowers the photosensitivity, and in addition, has an adverse effect on the fatigue behavior in the repetition.

Japanese Laid-Open Patent Application 9-240051 discloses an electrophotographic image forming apparatus which employs as a light source an LD beam with an oscillation wavelength of 400 to 500 nm. An electrophotographic photoconductor for use in the above-mentioned image forming apparatus is constructed in such a manner that a charge transport layer and a charge generation layer are successively overlaid on an electroconductive support in that order to aim at high resolution of the obtained image. However, the charge generation layer in the form of a fragile thin film is exposed to mechanical and chemical hazards in the cycle of charging, development, image transfer, and cleaning steps. The photoconductor deteriorates too badly to be used in practice.

The above-mentioned Japanese Laid-Open Patent Application 9-240051 also discloses an electrophoto-graphic photoconductor of a single-layered structure. This kind of photoconductor has the problems that design of the constituent materials is limited and the sensitivity cannot increase as high as that of the function-separation layered photoconductor.

In the field of the electrophotographic image forming apparatus such as printers and copying machines, the diameter of a photoconductor tends to decrease in line with the development of high-speed operation, small-size apparatus, and high-quality image formation. This tendency makes the operating conditions of the photoconductor much more severe in the electrophoto-graphic process.

For example, a charging roller and a cleaning rubber blade are disposed around the photoconductor. An increase in hardness of the rubber and an increase in contact pressure of the rubber blade with the photoconductor become unavoidable to obtain adequate cleaning performance. As a result, the photoconductor suffers from wear, and therefore, the potential and the sensitivity of the photoconductor are always subject to variation. Such variation produces abnormal images, impairs the color balance of color images, and lowers the color reproducibility.

In addition, when the photoconductor is operated for a long period of time, ozone generated in the course of the charging step oxidizes a binder resin and a charge transport material. Further, ionic compounds such as nitric acid ion, sulfuric acid ion, ammonium ion, and organic acid compound ion generated in the charging step are accumulated on the surface of the photoconductor, which will lead to great deterioration of image quality.

In light of the above, it is considered important to upgrade the durability of the photoconductor and improve the properties of the top surface layer of the photoconductor.

As means for solving the problem of deterioration of image quality, addition of a fluorine-containing resin such as polytetrafluoroethylene and a silicone resin such as polydimethylsiloxane to the photoconductive layer is proposed to decrease the surface energy of the photoconductor. This proposal aims to improve the durability of the photoconductor and to reduce the amount of ionic compounds deposited on the surface layer of the photoconductor.

For instance, the top surface layer of a photoconductor disclosed in Japanese Laid-Open Patent Application 4-368953 comprises finely-divided particles of a fluorine-containing resin. The top surface layer of a photoconductor disclosed in Japanese Laid-Open Patent Application 5-113670 comprises as a binder resin a siloxane-copolymerized polycarbonate resin to provide the top surface layer with lubricating properties. Namely, this proposal aims to improve the cleaning characteristics and to prevent moisture-absorption materials such as a toner and paper dust from being deposited in the form of a film on the surface layer of the photoconductor.

Furthermore, many trials have been made to prevent a decrease in image quality by providing a protective layer on the surface of the photoconductor.

For example, a protective layer comprising a variety of resins and fillers such as silica gel and tin oxide is provided on the surface of the photocondutor to improve the wear resistance of the photoconductor (Japanese Laid-Open Patent Applications 57-30843, 1-205171, 3-155558, 7-333881, 8-15887, 8-123053, 8-146641, and 8-179542.) Further, Japanese Patent Publication 5-046940 proposes the provision of a surface protective layer comprising a crosslinked polysiloxane made from a trifunctional alkoxysilane and a tetrafunctional alkoxysilane through hydrolysis and condensation.

However, the solubility of the fluorine-containing resin such as polytetrafluoroethylene in general-purpose solvents is very poor, so that it is difficult to achieve optically uniform dispersion. In addition, when such a fluorine-containing resin is added to any other resins, the fluorine-containing resin causes aggregation because of poor compatibility with other resins, whereby light scattering is induced. Further, the fluorine-containing resin tends to cause bleeding when added to any other resins.

When polysiloxane is added to other resins, the bleeding also occurs, with the result that the effect by the addition of the polysiloxane does not last for long. Furthermore, a polysiloxane is a polymer provided with electrical insulating properties, so that the charge transporting properties of the photoconductor are hindered by the polysiloxane when the protective layer contains a polysiloxane.

When the protective layer is prepared using a resin in which a filler is dispersed, the surface energy generally increases to impair the cleaning characteristics although the surface hardness of the photoconductor can improve. Further, the filler particles tend to aggregate in the protective layer to cause light scattering.

In addition to the above-mentioned problems, the potential of a light portion on the photoconductor tends to increase while the photoconductor is continuously used for an extended period of time. The result is that image quality is caused to deteriorate because of a decrease in image density and a decrease in image resolution.

SUMMARY OF THE INVENTION

Accordingly, it is a first object of the present invention to provide an electrophotographic photoconductor capable of maintaining excellent image quality, sufficient durability, and high sensitivity, with minimum variations in potential even after the repetition of electrophotographic process when not only a conventional light beam with an oscillation wavelength in the range of 780 to 800 nm, but also light with wavelengths of 400 to 450 nm is used as a light source for data recording.

A second object of the present invention is to provide an electrophotographic image forming method using the above-mentioned photoconductor.

A third object of the present invention is to provide an electrophotographic image forming apparatus including the above-mentioned photoconductor.

A fourth object of the present invention is to provide a process cartridge including the above-mentioned electrophotographic photoconductor.

A fifth object of the present invention is to provide a novel bisphenol compound containing a long-chain alkyl group.

A sixth object of the present invention is to provide a polymer with water repellency, useful as a binder resin for use in the electrophotographic photoconductor.

The above-mentioned first object of the present invention can be achieved by an electrophotographic photoconductor comprising an electroconductive support and a photoconductive layer which is formed on the electroconductive support and comprises at least one resin selected from the group consisting of a polyurethane resin, a polyester resin, and a polycarbonate resin, each of the resins comprising at least a structural unit represented by formula (1):

(1)

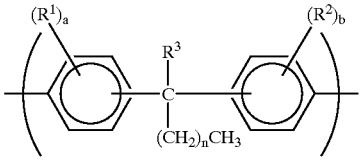

wherein $R^1$ and $R^2$ are each a halogen atom, a substituted or unsubstituted alkyl group having 1 to 6 carbon atoms, a substituted or unsubstituted alkoxyl group having 1 to 6 carbon atoms, or a substituted or unsubstituted aryl group; $R^3$ is a substituted or unsubstituted alkyl group having 1 to 6 carbon atoms or an alkyl group represented by $—(CH_2)_m CH_3$; a and b are each an integer of 0 to 4, and when a and b are each an integer of 2 to 4, a plurality of groups represented by $R^1$ or $R^2$ may be the same or different; and n and m are each an integer of 8 to 27.

The second object of the present invention can be achieved by an electrophotographic image forming method comprising the steps of charging a surface of the above-mentioned electrophotographic photoconductor, exposing the photoconductor to a light image to form a latent electrostatic image on the photoconductor, developing the latent electrostatic image to a visible image, and transferring the visible image formed on the photoconductor to an image receiving member.

The third object of the present invention can be achieved by an electrophotographic image forming apparatus comprising means for charging a surface of the above-mentioned electrophotographic photoconductor, means for exposing the photoconductor to a light image to form a latent electrostatic image on the photoconductor, means for developing the latent electrostatic image to a visible image, and means for transferring the visible image formed on the photoconductor to an image receiving member.

The fourth object of the present invention can be achieved by a process cartridge for use in the electrophotographic image forming apparatus, which is freely attachable to the electrophotographic image forming apparatus and detachable therefrom, the process cartridge comprising the above-mentioned electrophotographic photoconductor, and at least one means selected from the group consisting of a charging means for charging a surface of the photoconductor, a light exposure means for exposing the photoconductor to a light image to form a latent electrostatic image on the photoconductor, a development means for developing the latent electrostatic image to a visible image, and an image transfer means for transferring the visible image formed on the photoconductor to an image receiving member.

The fifth object of the present invention can be achieved by a bisphenol compound containing a long-chain alkyl group, represented by the following formula (2):

(2)

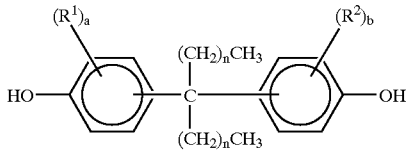

wherein $R^1$ and $R^2$are each a halogen atom, a substituted or unsubstituted alkyl group having 1 to 6 carbon atoms, a substituted or unsubstituted alkoxyl group having 1 to 6 carbon atoms, or a substituted or unsubstituted aryl group; a and b are each an integer of 0 to 4, and when a and b are each an integer of 2 to 4, a plurality of groups represented by $R^1$ or $R^2$ may be the same or different; and n is an integer of 9 to 15.

The sixth object of the present invention can be achieved by a polymer comprising a structural unit of formula (3):

(3)

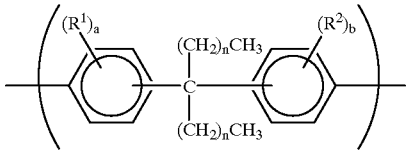

wherein $R^1$ and $R^2$ are each a halogen atom, a substituted or unsubstituted alkyl group having 1 to 6 carbon atoms, a substituted or unsubstituted alkoxyl group having 1 to 6 carbon atoms, or a substituted or unsubstituted aryl group; a and b are each an integer of 0 to 4, and when a and b are each an integer of 2 to 4, a plurality of groups represented by $R^1$ or $R^2$ may be the same or different; and n is an integer of 9 to 15.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
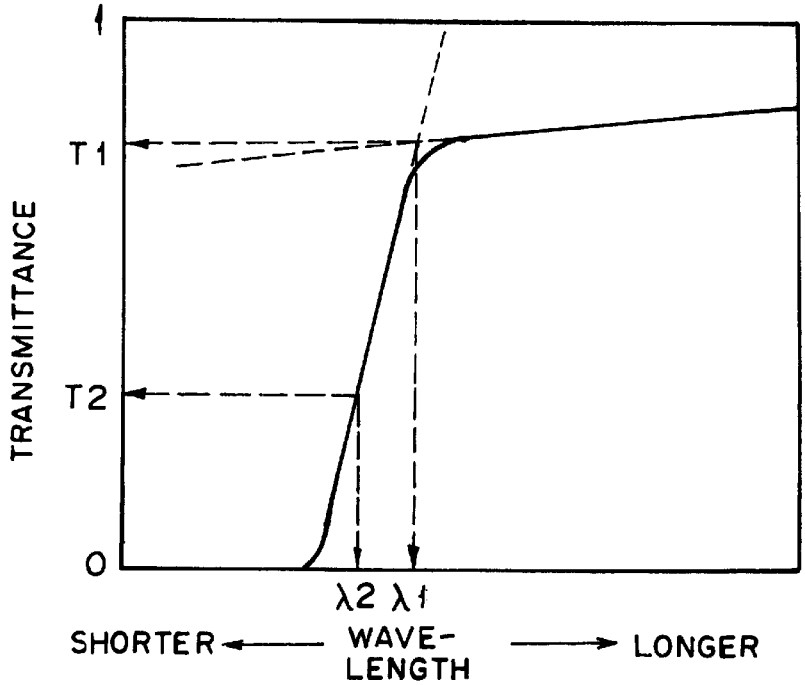
FIG. 1 is a transmission spectrum of a charge transport layer for use in an electrophotographic photoconductor, in explanation of the light transmitting properties of the charge transport layer.

The inventors of the present invention have intensively studied to solve the above-mentioned problems of the conventional electrophotographic photoconductors, with special attention being paid to the photoconductive layer, in particular, to a surface portion of the photoconductive layer. As a result, it is found that the conventional problems can be solved when a single-layered photoconductive layer, a charge transport layer of a layered photoconductive layer, or a protective layer provided on the surface of a photoconductor comprises a polyurethane resin, a polyester resin, or a polycarbonate resin, each including a specific structural unit. In other words, by use of the photoconductor of the present invention, excellent image quality can be maintained and high sensitivity and durability can be attained with minimum variations in potential even after the electrophotographic process is repeated. Such advantages can be obtained when a light source for recording data on the photoconductor adapts not only the conventional light with an oscillation wavelength in the range of 780 to 800 nm, but also the previously mentioned LD or LED with wavelengths of 400 to 450 nm.

The electrophotographic photoconductor of the present invention comprises an electroconductive support and a photoconductive layer which is formed on the electroconductive support and comprises at least one resin selected from the group consisting of a polyurethane resin, a polyester resin, and a polycarbonate resin, each resin having at least a structural unit represented by the following formula (1):

(1)

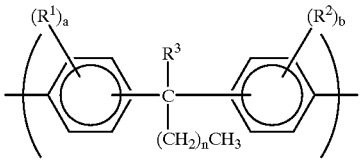

wherein $R^1$ and $R^2$ are each a halogen atom, a substituted or unsubstituted alkyl group having 1 to 6 carbon atoms, a substituted or unsubstituted alkoxyl group having 1 to 6 carbon atoms, or a substituted or unsubstituted aryl group; $R^3$ is a substituted or unsubstituted alkyl group having 1 to 6 carbon atoms or an alkyl group represented by $—(CH_2)_m CH_3$; a and b are each an integer of 0 to 4, and when a and b are each an integer of 2 to 4, a plurality of groups represented by $R^1$ or $R^2$ may be the same or different; and n and m are each an integer of 8 to 27.

The above-mentioned photoconductive layer may be a single-layered photoconductive layer.

The photoconductive layer may be of a function-separation layered type, with a charge generation layer and a charge transport layer being successively overlaid on an electroconductive layer in that order. In this case, the charge generation layer comprises a charge generation material, and the charge transport layer comprises a charge transport material and at least one resin selected from the group consisting of a polyurethane resin, a polyester resin, and a polycarbonate resin, each resin having at least a structural unit represented by the above-mentioned formula (1).

Further, in the above-mentioned function-separation layered photoconductor, the charge transport layer may have a layered structure that a first charge transport layer comprising a charge transport material and a second charge transport layer comprising a charge transport material and at least one resin selected from the above-mentioned resin group are successively provided on the charge generation layer in this order.

In the aforementioned function-separation layered photoconductor, it is preferable that the charge transport layer transmit monochromatic light with wavelengths of 390 to 460 nm.

Furthermore, the electrophotographic photoconductor of the present invention comprises an electroconductive support, a photoconductive layer formed thereon, and a protective layer which is formed on the photoconductive layer and comprises at least one resin selected from the group consisting of a polyurethane resin, a polyester resin, and a polycarbonate resin, each resin having at least a structural unit represented by the above-mentioned formula (1).

The polyurethane resin, the polyester resin, and the polycarbonate resin, each having at least a structural unit of formula (1), will now be explained in detail. These resins will also be referred to as resins for use in the present invention.

In formula (1), examples of the halogen atom represented by $R^1$ and $R^2$ are a fluorine atom, a chlorine atom, a bromine atom, and an iodine atom.

The alkyl group represented by $R^1$ and $R^2$ is a straight-chain, branched, or cyclic alkyl group having 1 to 6 carbon atoms. The alkyl group may have a substituent such as a fluorine atom, cyano group, or a phenyl group which may have a substituent selected from the group consisting of a halogen atom, and a straight-chain, branched, or cyclic alkyl group having 1 to 6 carbon atoms.

Specific examples of such a substituted or unsubstituted alkyl group represented by $R^1$ and $R^2$ are methyl group, ethyl group, n-propyl group, i-propyl group, t-butyl group, s-butyl group, n-butyl group, i-butyl group, trifluoromethyl group, 2-cyanoethyl group, benzyl group, 4-chlorobenzyl group, 4-methylbenzyl group, cyclopentyl group, and cyclohexyl group.

Specific examples of the alkoxyl group having 1 to 6 carbon atoms represented by $R^1$ and $R^2$ are methoxy group, ethoxy group, n-propoxy group, i-propoxy group, n-butoxy group, i-butoxy group, s-butoxy group, t-butoxy group, 2-hydroxyethoxy group, 2-cyanoethoxy group, benzyloxy group, 4-methylbenzyloxy group, and trifluoromethoxy group.

The substituted or unsubstituted aryl group represented by $R^1$ and $R^2$ includes a heterocyclic group. Specific examples of the aryl group represented by $R^1$ and $R^2$ are phenyl group, naphthyl group, biphenylyl group, terphenylyl group, pyrenyl group, fluorenyl group, 9,9-dimethyl-2-fluorenyl group, azulenyl group, anthryl group, triphenylenyl group, chrysenyl group, fluorenylidenephenyl group, 5H-dibenzo[a,d] cycloheptenylidenephenyl group, thienyl group, benzothienyl group, furyl group, benzofuranyl group, carbazolyl group, pyridinyl group, pyrrolidyl group, and oxazolyl group.

The above-mentioned aryl group may have a substituent such as the previously mentioned substituted or unsubstituted alkyl group, substituted or unsubstituted alkoxyl group, or halogen atom.

Examples of the substituted or unsubstituted alkyl group represented by $R^3$ are the same as those previously defined by $R^1$ and $R^2$.

The above-mentioned polyurethane resin, polyester resin, or polycarbonate resin comprises the structural unit of formula (1), and may further comprise a group represented by the following formula (4):

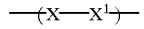

(4)

wherein $X^1$ is iminocarbonyloxy group, oxycarbonyl group, or oxycarbonyloxy group; and X is a bivalent aliphatic hydrocarbon group having 2 to 20 carbon atoms, which may have a substituent, a bivalent alicyclic hydrocarbon group which may have a substituent, a bivalent aromatic hydrocarbon group having 6 to 20 carbon atoms, which may have a substituent, a bivalent group prepared by bonding the above-mentioned bivalent groups, or a bivalent group of formula (i), (ii) or (iii):

(i)

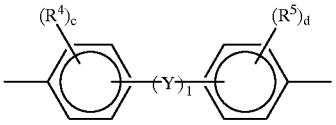

(ii)

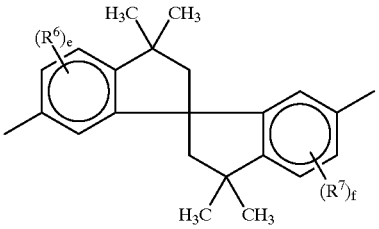

(iii)

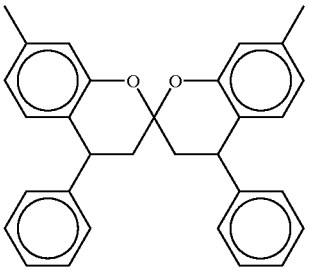

in which $R^4$, $R^5$, $R^6$, and $R^7$ are each independently a halogen atom, a substituted or unsubstituted alkyl group having 1 to 6 carbon atoms, or a substituted or unsubstituted aryl group, and a plurality of groups represented by $R^4$, $R^5$, $R^6$, or $R^7$ may be the same or different; c and d are each independently an integer of 0 to 4; e and f are each independently an integer of 0 to 3; and X is an integer of 0 or 1, and when l=1, Y is a straight-chain alkylene group having 2 to 12 carbon atoms, a substituted or unsubstituted branched alkylene group having 3 to 12 carbon atoms, a bivalent group comprising at least one alkylene group having 1 to 10 carbon atoms and at least one oxygen atom and/or sulfur atom, —O—, —S—, —SO—, —$SO_2$—, —CO—, —COO—, (IV)

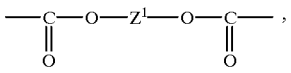

(V)

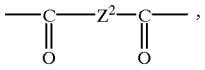

(VI)

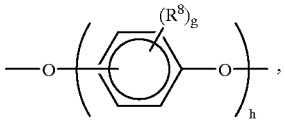

(VII)

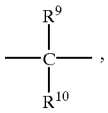

(VIII)

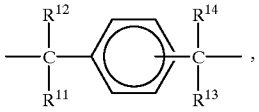

(IX)

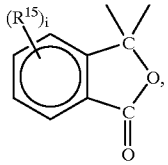

(X)

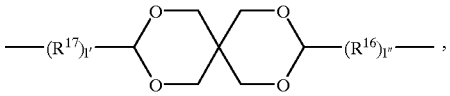

(XI)

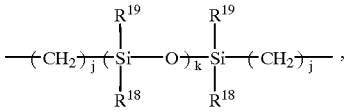

(XII)

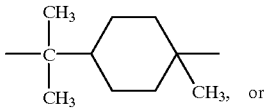

(XIII)

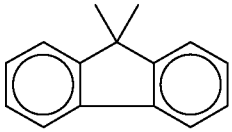

in which $Z^1$ and $Z^2$ are each a substituted or unsubstituted bivalent aliphatic hydrocarbon group having 2 to 20 carbon atoms or a substituted or unsubstituted arylene group; $R^8$ is a halogen atom, a substituted or unsubstituted alkyl group having 1 to 6 carbon atoms, a substituted or unsubstituted alkoxyl group having 1 to 6 carbon atoms, or a substituted or unsubstituted aryl group; $R^9$ and $R^{10}$ are each independently a hydrogen atom, a halogen atom, a substituted or unsubstituted alkyl group having 1 to 6 carbon atoms, a substituted or unsubstituted alkoxyl group having 1 to 6 carbon atoms, or a substituted or unsubstituted aryl group, and $R^9$ and $R^{10}$ may form a carbon ring having 5 to 12 carbon atoms in combination; $R^{11}$, $R^{12}$, $R^{13}$, and $R^{14}$ are each independently a hydrogen atom, a halogen atom, a substituted or unsubstituted alkyl group having 1 to 6 carbon atoms, a substituted or unsubstituted alkoxyl group having 1 to 6 carbon atoms, or a substituted or unsubstituted aryl group; $R^{15}$ is a halogen atom, a substituted or unsubstituted alkyl group having 1 to 6 carbon atoms, a substituted or unsubstituted alkoxyl group having 1 to 6 carbon atoms, or a substituted or unsubstituted aryl group; l' and l" are each an integer of 0 or 1, and when l'=1 and l"=1, $R^{17}$ and $R^{16}$ are each an alkylene group having 1 to 4 carbon atoms; $R^{18}$ and $R^{19}$ are each independently a substituted or unsubstituted alkyl group having 1 to 6 carbon atoms or a substituted or unsubstituted aryl group; g is an integer of 0 to 4; h is an integer of 1 or 2; i is an integer of 0 to 4; j is an integer of 0 to 20; and k is an integer of 0 to 2000.

In the case where X in formula (4) represents a substituted or unsubstituted bivalent aliphatic hydrocarbon group or a substituted or unsubstituted bivalent alicyclic hydrocarbon group, there can be employed bivalent groups obtained by removing two hydroxyl groups from the following diols: ethylene glycol, diethylene glycol, triethylene glycol, polyethylene glycol, polytetramethylene ether glycol, 1,3-propanediol, 1, 4-butanediol, 1,5-pentanediol, 3-methyl-1, 5-pentanediol, 1,6-hexanediol, 1,5-hexanediol, 1,7-heptanediol, 1,8-octanediol, 1,9-nonanediol, 1,10-decanediol, 1,11-undecanediol, 1,12-dodecanediol, neopentyl glycol, 2-ethyl-1,6-hexanediol, 2-methyl-1,3-propanediol, 2-ethyl-1,3-propanediol, 2,2-dimethyl-1,3-propanediol, 1,3-cyclohexanediol, 1,4-cyclohexanediol, cyclohexane-1,4-dimethanol, 2,2-bis(4-hydroxycyclohexyl) propane, xylylenediol, 1,4-bis (2-hydroxyethyl)benzene, 1,4-bis (3-hydroxypropyl)benzene, 1,4-bis(4-hydroxybutyl) benzene, 1,4-bis(5-hydroxypentyl)benzene, 1,4-bis(6-hydroxyhexyl)benzene, and isophorone diol.

When X in formula (4) represents a substituted or unsubstituted bivalent aromatic hydrocarbon group, any bivalent groups derived from the substituted and unsubstituted aryl groups mentioned above can be employed.

In formula (x), when $R^{17}$ and $R^{15}$ are each an alkylene group having 1 to 4 carbon atoms, any bivalent groups derived from the previously mentioned substituted and unsubstituted alkyl groups can be used.

When Y in formula (i) represents a bivalent group comprising at least one alkylene group having 1 to 10 carbon atoms and at least one oxygen atom and/or sulfur atom, the following specific examples can be employed:

$OCH_2CH_2O$,
$OCH_2CH_2OCH_2CH_2O$,
$OCH_2CH_2OCH_2CH_2OCH_2CH_2O$,
$OCH_2CH_2CH_2O$,
$OCH_2CH_2CH_2CH_2O$,
$OCH_2CH_2CH_2CH_2CH_2CH_2O$,
$OCH_2CH_2CH_2CH_2CH_2CH_2CH_2CH_2O$,
$CH_2O$,
$CH_2CH_2O$,
$CHE_tOCHE_tO$ ($E_t$=ethylene group),
$CHCH_3O$,
$SCH_2O\ CH_2S$,
$CH_2O\ CH_2$,
$OCH_2O\ CH_2O$,
$SCH_2CH_2OCH_2O\ CH_2CH_2S$,
$OCH_2CHCH_3OCH_2CHCH_3O$,
$SCH_2S$, $SCH_2CH_2S$, $SCH_2CH_2CH_2S$, $SCH_2CH_2CH_2CH_2S$, $SCH_2CH_2CH_2CH_2CH_2CH_2S$, $SCH_2CH_2SCH_2CH_2S$, and $SCH_2CH_2OCH_2CH_2OCH_2CH_2S$.

When Y in formula (i) represents a branched alkylene group having 3 to 12 carbon atoms, a substituted or unsubstituted aryl group or a halogen atom can be employed as the substituent.

When $Z^1$ and $Z^2$ are each a substituted or unsubstituted bivalent aliphatic hydrocarbon group, there can be employed any bivalent groups obtained by removing hydroxyl groups from the above-mentioned diols.

When $Z^1$ and $Z^2$ are each a substituted or unsubstituted arylene group, there can be employed any bivalent groups derived from the above-mentioned substituted or unsubstituted aryl group.

Preferable examples of the bivalent aromatic hydrocarbon group represented by X in formula (4) are prepared by removing two hydroxyl groups from the following diols:

bis(4-hydroxyphenyl)methane, bis(2-methyl-4-hydroxyphenyl)methane, bis(3-methyl-4-hydroxyphenyl)methane, 1,1-bis(4-hydroxyphenyl)ethane, 1,2-bis(4-hydroxyphenyl)ethane, bis(4-hydroxyphenyl)phenylmethane, bis(4-hydroxyphenyl)diphenylmethane, 1,1-bis(4-hydroxyphenyl)-1-phenylethane, 1,3-bis(4-hydroxyphenyl)-1,1-dimethylpropane, 2,2-bis(4-hydroxyphenyl)propane, 2-(4-hydroxyphenyl)-2-(3-hydroxyphenyl)propane, 1,1-bis(4-hydroxyphenyl)-2-methylpropane, 2,2-bis(4-hydroxyphenyl)butane, 1,1-bis(4-hydroxyphenyl)-3-methylbutane, 2,2-bis(4-hydroxyphenyl)pentane, 2,2-bis(4-hydroxyphenyl)-4-methylpentane, 2,2-bis(4-hydroxyphenyl)hexane, 4,4-bis(4-hydroxyphenyl)heptane, 2,2-bis(4-hydroxyphenyl)nonane, bis(3,5-dimethyl-4-hydroxyphenyl)methane, 2,2-bis(3-methyl-4-hydroxyphenyl)propane, 2,2-bis(3-isopropyl-4-hydroxyphenyl)propane, 2,2-bis(3-sec-butyl-4-hydroxyphenyl)propane, 2,2-bis(3-tert-butyl-4-hydroxyphenyl)propane, 2,2-bis(3-cyclohexyl-4-hydroxyphenyl)propane, 2,2-bis(3-allyl-4-hydroxyphenyl)propane, 2,2-bis(3-phenyl-4-hydroxyphenyl)propane, 2,2-bis(3,5-dimethyl-4-hydroxyphenyl) propane, 2,2-bis(3-chloro-4-hydroxyphenyl)propane, 2,2-bis(3,5-dichloro-4-hydroxyphenyl)propane, 2,2-bis(3-broono-4-hydroxyphenyl)propane, 2,2-bis(3,5-dibromo-4-hydroxyphenyl)propane, 2,2-bis( 4-hydroxyphenyl)hexafluoropropane, 1,1-bis(4-hydroxyphnxyphenyl)opentane, 1,1-bis(4-hydroxyphenyl)cyclohexane, 1,1-bis(3-methyl-4-hydroxyphenyl)cyclohexane, 1,1-bis(3,5-dimethyl-4-hydroxyphenyl)cyclohexane, 1,1-bis(3,5-dichloro-4-hydroxyphenyl)cyclohexane, 1,1-bis(4-hydroxyphenyl)-3,3,5-trimethylcyclohexane, 1,1-bis(4-hydroxyphenyl)cycloheptane, 2,2-bis(4-hydroxyphenyl)norbornane, 2,2-bis(4-hydroxyphenyl)adamantane, 4,4'-dihydroxydiphenyl ether, 4,4'-dihydroxy-3,3'-dimethyldiphenyl ether, ethylene glycol bis(4-hydroxyphenyl)ether, 1,3-bis(4-hydroxyphenoxy)benzene, 1,4-bis(3-hydroxyphenoxy)benzene, 4,4'-dihydroxydiphenylsulfide, 3,3'-dimethyl-4,4'-dihydroxydiphenylsulfide, 3,3',5,5'-tetramethyl-4,4'-dihydroxydiphenylsulfide, 4,4'-dihydroxydiphenylsulfoxide, 3,3'-dimethyl-4,4'-dihydroxydiphenylsulfoxide, 4,4'-dihydroxydiphenylsulfone, 3,3'-dimethyl-4,4'-dihydroxydiphenylsulfone, 3,3'-diphenyl-4,4'-dihydroxydiphenylsulfone, 3,3'-dichloro-4,4'-dihydroxydiphenylsulfone, bis(4-hydroxyphenyl)ketone, bis(3-methyl-4-hydroxyphenyl)ketone, 3,3,3',3'-tetramethyl-6,6'-dihydroxyspiro(bis)indane, 3,3',4,4'-tetrahydro-4,4,4',4'-tetramethyl-2,2'-spirobi(2H-1-benzopyran)-7,7'-diol, trans-2,3-bis(4-hydroxyphenyl)-2-butene, 9,9-bis(4-hydroxyphenyl)fluorene, 9,9-bis(4-hydroxyphenyl)xanthene, 1,6-bis(4-hydroxyphenyl)-1,6-hexanedione, α,α,α',α'-tetramethyl-α,α'-bis(4-hydroxyphenyl)-p-xylene, α, α,α',α'-tetramethyl-α,α'-bis(4-hydroxyphenyl)-m-xylene, 2,6-dihydroxybenzo-p-dioxine, 2,6-dihydroxythianthrene, 2,7-dihydroxyphenoxthine, 9,10-dimethyl-2,7-dihydroxyphenazine, 3,6-dihydroxydibenzofuran, 3,6-dihydroxydibenzothiophene, 4,4'-dihydroxybiphenyl, 1,4-dihydroxynaphthalene, 2,7-dihydroxypyrene, hydroquinone, resorcin, 4-hydroxyphenyl-4-hydroxybenzoate, ethylene glycol-bis(4-hydroxybenzoate), diethylene glycol-bis(4-hydroxybenzoate), triethylene glycol-bis(4-hydroxybenzoate), p-phenylene-bis(4-hydroxybenzoate), 1,6-bis(4-hydroxybenzoyloxy)-1H,1H,6H,6H-perfluorohexane, 1,4-bis(4-hydroxybenzoyloxy)-1H,1H,4H,4H-perfluorobutane, and 1,3-bis(4-hydroxyphenyl)tetramethyldisiloxane.

The polyurethane resin comprising the structural unit of formula (1) for use in the present invention can be produced by the conventional methods, for example, by polyaddition reaction between a diol and a di-isocyanate, and condensation polymerization of a diamine and a bischloroformate. The method of producing the polyurethane resin is described in detail in some references (e.g., The Society of Polymer Science, Japan, Ed, *Synthesis and Reaction of Polymers* [2]—*Synthesis of Condensed Polymers—New Polymer Experiment* 3: Kyoritsu Shuppan Co., Ltd., pp. 117–119, pp. 229–233.) More specifically, a diol represented by HO-A-OH, where A is the same bivalent group as that represented by the above-mentioned formula (1), is allowed to react with a di-isocyanate to prepare a polyurethane resin for use in the present invention. This reaction can be carried out under the conventional conditions concerning the reaction temperature, solvent, catalyst, and molecular weight modifier.

In the polymerization reaction of the diol and di-isocyanate, a terminator is preferably employed as the molecular weight modifier to control the molecular weight of the obtained polyurethane resin. Consequently, a substituent derived from the terminator may be bonded to the end of the molecule of the obtained polyurethane resin.

As the terminator for use in the present invention, a monovalent aromatic hydroxy compound and haloformate derivatives thereof, and a monovalent carboxylic acid and halide derivatives thereof can be used alone or in combination.

In particular, monovalent aromatic hydroxy compounds such as phenol, p-tert-butylphenol, p-cumylphenol, and phenyl chloroformate are preferably used as the terminators for use in the present invention.

The polyurethane resin thus obtained is purified by removing the catalyst and the antioxidant used in the polymerization, unreacted diol and terminator, and impurities such as an inorganic salt generated during the polymerization.

The polyester resin comprising the structural unit of formula (1) for use in the present invention can be produced, for example, by nucleophilic acyl substitution polymerization between a diol (including a bisphenol) and a dicarboxylic acid derivative, or nucleophilic aliphatic hydrocarbon group substitution polymerization between a dicarboxylate and an aliphatic hydrocarbon dihalide. Such preparation methods for the polyester resin are explained in detail in some references (e.g., The Society of Polymer Science, Japan, Ed, *Synthesis and Reaction of Polymers* [2]—*Synthesis of Condensed Polymers—New Polymer Experiment* 3: Kyoritsu Shuppan Co., Ltd., pp. 49–54, pp. 77–95.) These reactions can be carried out under the conventional conditions concerning the reaction temperature, solvent, catalyst, and molecular weight modifier.

In the polymerization reaction of the diol and the dicarboxylic acid derivative, a terminator is preferably employed as the molecular weight modifier to control the molecular weight of the obtained polyester resin. Consequently, a substituent derived from the terminator may be bonded to the end of the molecule of the obtained polyester resin.

The polycarbonate resin comprising the structural unit of formula (1) for use in the present invention can be produced, for example, by polymerization reaction between a bisphenol compound and a carbonic acid derivative, as described in "Handbook of Polycarbonate Resin" (issued by Nikkan Kogyo Shimbun Ltd.) To be more specific, the polycarbonate resin can be produced by ester interchange with a bisarylcarbonate compound using at least one kind of diol. Alternatively, polymerization of a diol with a halogenated carbonyl compound such as phosgene may be carried out in accordance with solution polymerization or interfacial polymerization. Or polymerization of a diol with a chloroformate such as bischloroformate derived from the diol may be employed. Further, a copolymer polycarbonate resin may be used in order to control the mechanical properties. The reaction can be carried out under the conventional conditions concerning the reaction temperature, solvent, catalyst, and molecular weight modifier.

To control the molecular weight of the obtained polycarbonate resin, it is desirable to employ a terminator as the molecular weight modifier in the polymerization reaction of a diol and a dicarboxylic acid derivative. Consequently, a substituent derived from the terminator may be bonded to the end of the molecule of the obtained polycarbonate resin.

It is preferable that the polyurethane resin, polyester resin, or polycarbonate resin used in the photoconductor of the present invention have a weight-average molecular weight of 1,000 to 1,000,000, and more preferably in the range of 2,000 to 500,000 when expressed by the styrene-reduced value. When the molecular weight of each of the above-mentioned resins is within the above-mentioned range, the mechanical strength is sufficient enough to prevent occurrence of cracks in a resin film in the course of film formation. At the same time, the solubility of each resin in generally used solvents is appropriate, and the viscosity of the obtained resin solution can be prevented from increasing, which will lead to improvement in the coating performance.

Furthermore, a branching agent may be added in a small amount during the aforementioned polymerization reaction in order to improve the mechanical properties of the obtained resin. Any compounds that have three or more reactive groups, which may be the same or different, selected from the group consisting of an aromatic hydroxyl group, a haloformate group, a carboxylic acid group, a carboxylic acid halide group, and an active halogen atom can be used as the branching agents for use in the present invention. These branching agents may be used alone or in combination.

The photoconductor of the present invention is characterized in that a photoconductive layer containing at least one of the above-mentioned polyurethane resin, polyester resin, or polycarbonate resin is provided on an electroconductive support. The above-mentioned polyurethane resin, polyester resin, and polycarbonate resin serve as binder resins, which can decrease the surface energy of the photoconductor. When these resins are placed in the outermost surface portion of the photoconductor, that is, located farthest from the electroconductive support, the resins can work to lower the surface energy of the photoconductor.

More specifically, the effect of decreasing the surface energy is attributed to the presence of at least one long-chain alkyl group in a molecular of the structural unit represented by formula (1) contained in each resin for use in the present invention. It is commonly known that the critical surface tension of a liquid on a surface made of a compound having a long-chain alkyl group in its molecule is as small as the critical surface tension obtained by a siloxane resin. When any of the resins for use in the present invention is disposed in the surface portion of the photoconductor, the frictional resistance of the surface portion can be made small, thereby promoting the durability of the photoconductor. At the same time, the resins for use in the present invention can work to reduce the amount of the ionic compound deposited on the photoconductor, this compound being considered to be one of the causes to decrease the image quality. Therefore, high quality images can be produced for an extended period of time using the photoconductor of the present invention.

The resins comprising a structural unit of formula (1) have the advantages that the degree of freedom in synthesis is high and the resin structure can be easily adjusted to cope with the desired surface properties of the photoconductor.

This is because the number of chains in a long-chain alkyl moiety can be chosen within a wide range. In the present invention, the long-chain alkyl group in the structural unit of formula (1) is specified by the number of n, and the long-chain alkyl group represented by $R^3$ is also specified by the number of m, that is, both by defining n and m as integers of 8 to 27. When n and m are each an integer of 7 or less, the critical surface tension of a liquid on the resin-containing surface cannot sufficiently increase. When n and m are each an integer of 28 or more, crystallizability of a monomer tends to increase, thereby making the preparation of the resin difficult.

As mentioned above, the polyurethane resin, polyester resin, and polycarbonate resins for use in the present invention can decrease the surface energy of the photoconductor. These resins can therefore serve as the binder resins when contained in a photoconductive layer or a charge transport layer of a layered photoconductor. When a protective layer is overlaid on the photoconductive layer or the charge transport layer, it is advantageous to employ these resins in the protective layer in light of the functions of these resins.

In the polyurethane resin, polyester resin, or polycarbonate resin having a structural unit of formula (1), it is preferable that the content of the structural unit of formula (1) be 1 mol % or more, more preferably 5 mol % or more, and further preferably 20 mol % or more. When the content of the structural unit of formula (1) is less than 1 mol %, the critical surface tensions of liquids become so large when the liquids are deposited on the resin-containing surface portion that the effect of decreasing the surface energy cannot be exhibited in practice.

Since the resins for use in the present invention have the properties that can decrease the surface energy of the photoconductor, these resins can effectively work as the binders in the photoconductive layer, charge transport layer, or protective layer.

According to the present invention, desired characteristics for maintaining the image quality can be imparted to the photoconductor by adding the above-mentioned polyurethane, polyester, or polycarbonate resin to the photoconductive layer, charge transport layer, or protective layer to reduce the surface energy of the photoconductor. Furthermore, each of the above-mentioned layers may comprise a filler to improve the mechanical durability of the photoconductor. Namely, when the photoconductive layer, charge transport layer, or protective layer comprises any of the above-mentioned resins and a filler in combination, the wear resistance of the photoconductor can be improved, while formation of high-quality images can be maintained, with a minimum change in electrical potential in the repeated operations. The photoconductor is superior in durability and sensitivity.

Examples of the above-mentioned filler for use in the present invention are titanium oxide, tin oxide, zinc oxide, zirconium oxide, indium oxide, silicon nitride, calcium oxide, barium sulfate, silica, colloidal silica, alumina, carbon black, finely-divided particles of fluoroplastics, finely-divided particles of polysiloxane resin, finely-divided particles of polyethylene resin, and a graft copolymer with a core/shell structure.

The filler may be surface-treated with an inorganic or organic material in order to improve the dispersion properties. For hydrophobic surface treatment, the filler is usually treated with a silane coupling agent, fluorine-containing silane coupling agent, or a higher fatty acid. Further, the surface of the filler may be treated with an inorganic material such as alumina, zirconia, tin oxide, or silica.

It is preferable that the amount ratio by weight of filler be in the range of 5 to 50 wt. %, and more preferably 10 to 40 wt. %, of the total weight of a layer where the filler is contained. When the filler is contained in an amount of 5 to 50 wt. % of the total weight of the filler-containing layer, the wear resistance of the layer can sufficiently improve, without impairing transparency of the photoconductive layer as a whole.

The mean particle diameter of the filler may be in the range of 0.05 to 1.0 $\mu$m, preferably in the range of 0.05 to 0.8 $\mu$m. When the filler has the mean particle diameter of 0.05 $\mu$m or more, improvement of wear resistance can be expected. On the other hand, when the filler with a mean particle diameter of 1.0 $\mu$m or less is employed, the surface roughness of the filler-containing layer is acceptable, and there is no possibility that protruding filler particles will damage a cleaning blade disposed in contact with the surface of the photoconductor. Defective cleaning performance can be thus prevented.

The photoconductive layer or charge transport layer may further comprise a charge transport material for imparting a charge transporting function to the corresponding layer. The charge transport material may be used alone or a plurality of charge transport materials may be used in combination.

The charge transport material is divided into two groups, a positive hole transporting material and an electron transporting material.

Examples of the positive hole transporting materials serving as the charge transport materials are oxazole derivatives, oxadiazole derivatives (Japanese Laid-Open Patent Applications 52-139065 and 52-139066), imidazole derivatives, triphenylamine derivatives (Japanese Laid-Open Patent Application 3-285960), benzidine derivatives (Japanese Patent Publication 58-32372), α-phenylstilbene derivatives (Japanese Laid-Open Patent Application 57-73075), hydrazone derivatives (Japanese Laid-Open Patent Applications 55-154955, 55-156954, 55-52063, and 56-81850), triphenylmethane derivatives (Japanese Patent Publication 51-10983), anthracene derivatives (Japanese Laid-Open Patent Application 51-94829), styryl derivatives (Japanese Laid-Open Patent Applications 56-29245 and 58-198043), carbazole derivatives (Japanese Laid-Open Patent Application 58-58552), and pyrene derivatives (Japanese Laid-Open Patent Application 2-94812).

Examples of the high-molecular weight positive hole transporting materials are poly-N-carbazole derivatives, poly-y -carbazolylethyl glutamate derivatives, derivatives of pyrene-formaldehyde condensation product, polyvinyl pyrene, polyvinyl phenanthrene, oxazole derivatives, imidazole derivatives, acetophenone derivatives (Japanese Laid-Open Patent Application 7-325409), distyrylbenzene derivatives, diphenetylbenzene derivatives (Japanese Laid-Open Patent Application 9-127713), a-phenylstilbene derivatives (Japanese Laid-Open Patent Application 9-297419), butadiene derivatives (Japanese Laid-Open Patent Application 9-80783), butadiene hydroxide (Japanese Laid-Open Patent Application 9-80784), diphenylcyclohexane derivatives (Japanese Laid-Open Patent Application 9-80772), distyryltriphenylamine derivatives (Japanese Laid-Open Patent Application 9-222740), diphenyldistyrylbenzene derivatives (Japanese Laid-Open Patent Applications 9-265197 and 9-265201), stilbene derivatives (Japanese Laid-Open Patent Application 9-211877), m-phenylenediamine derivatives (Japanese Laid-Open Patent Applications 9-304956 and 9-304957), resorcin derivatives (Japanese Laid-Open Patent Application 9-329907), triarylamine derivatives (Japanese Laid-Open Patent Applications 64-9964, 7-199503, 8-176293, 8-208820, 8-253568, 8-269446, 3-221522, 4-11627, 4-183719, 4-124163, 4-320420, 4-316543, 5-310904, 7-56374 and 8-62864, and U.S. Pat. Nos. 5,428,090 and 5,486,439).

Examples of the electron transporting materials include diphenoquinone derivatives, benzoquinone derivatives, malononitrile derivatives, thiopyran derivatives, tetracyanoethylene derivatives, fluorenone derivatives such as 3,4,5,7-tetranitro-9-fluorenone, dinitrobenzene derivatives, dinitroanthracene derivatives, dinitroacridine derivatives, nitroanthraquinone derivatives, dinitroanthraquinone derivatives, succinic anhydride derivatives, maleic anhydride derivatives, and dibromomaleic anhydride derivatives.

It is preferable that the amount of charge transport material be in the range of 0.2 to 3 parts by weight, and more preferably 0.4 to 1.5 parts by weight, to one part by weight of the above-mentioned resin for use in the present invention.

For the photoconductor of the present invention, conventional semiconductor laser diode (LD) with wavelengths of 780 to 800 nm, and a typical light emitting diode (LED) with a wavelength of 740 nm are used as light sources for data recording.

Further, a semiconductor laser diode (LD) or light emitting diode (LED) with wavelengths of 400 to 450 nm can also be employed, which is designed to cope with the digital recording system capable of increasing the recording density and the resolution. Such an LD or LED with wavelengths of 400 to 450 nm exhibits a remarkably narrow light emitting wavelength distribution, but the distribution may be shifted toward a shorter wavelength side or a longer wavelength side by several nanometers depending upon the ambient temperature and production lot. In consideration of the above-mentioned point, it is preferable that the charge transport layer for use in the present invention allow light with wavelengths of 390 to 460 nm to pass through. Since the light emitting wavelength distribution of such an LD or LED is very narrow, it is not necessary that the charge transport layer transmit light throughout the entire wavelength region of the above-mentioned LD or LED. Namely, it is preferable that only one desired monochromatic light within the wavelength region of 390 to 460 nm pass through the charge transport layer. In this case, it is desirable that the light transmitting properties of the charge transport layer, which will be described in detail with reference to FIG. 1, be 50% or more, and more preferably 90% or more, when the charge transport layer is irradiated with the above-mentioned monochromatic light.

In practice, the charge transport layer is incorporated in a drum- or sheet-shaped photoconductor. Therefore, with the manufacturing conditions being taken into consideration, the charge transport layer does not form a plane surface and is not provided with complete surface smoothness. As a result, the amount of light entering the charge transport layer necessarily decreases because of light scattering and light reflection by the surface of the charge transport layer. The above-mentioned light transmitting properties defined in the present invention simply means the amount of light obtained by subtracting the light scattered and reflected by the charge transport layer from the total amount of light entering the charge transport layer. In other words, the light transmitting properties mean a ratio of light volume obtained after passing through the charge transport layer to light volume of incident light to the charge transport layer.

FIG. 1 is a transmission light spectrum of a charge transport layer. The charge transport layer exhibits such a transmission spectrum as in FIG. 1 when the charge transport layer is irradiated with light with wavelengths of 390 to 460 nm. For example, when a light source employs a monochromatic light of a wavelength λ2 (nm) in an electrophotographic image forming apparatus, the light transmitting properties of the charge transport layer with respect to the monochromatic light having a wavelength λ2 can be obtained in accordance with the following formula (B):

$$\text{Light Transmitting Properties } (\%) = T_2/T_1 \times 100 \quad \text{(B)}$$

wherein $T_1$ is the transmittance at a wavelength Al which is longer than the wavelength λ2, provided that a value of $T_1$ shows a maximum transmittance in the wavelength region of 390 to 460 nm; and $T_2$ is the transmittance at the wavelength λ1.

It is preferable that the contact angle which pure water makes with the surface of the photoconductor according to the present invention be 85° or more, and more preferably 95° or more. The above-mentioned contact angle of 85° or more means sufficient water repellency resulting from a long-chain alkyl group of the resins for use in the present invention. Namely, the surface energy of the resin-containing photoconductor can be decreased as desired. When the contact angle of pure water is less than 85°, foreign materials generated by a charging step and some components contained in a toner and paper are easily attached to the surface of the photoconductor during repeated electrophotographic process. Thus, defective cleaning and decreased surface resistivity will hinder the formation of latent images on the photoconductor, thereby causing image blurring. On the other hand, when the above-mentioned contact angle of pure water with the surface of the photoconductor is excessively large, the toner cannot deposit on the photoconductor in a development step . Therefore, the upper limit of the aforementioned contact angle of pure water is preferably 140°.

When some of the conventional binder resins with low surface energies are used for the surface top layer of a photoconductor, the contact angle which pure water makes with the surface top layer is 100° or more at the initial stage owing to orientation of the employed resins in the surface portion. In this case, however, the contact angle drastically decreases as the surface top layer of the photoconductor is mechanically abraded. For example, even when the surface top layer contains a siloxane-copolymerized polycarbonate, that is well known as a binder resin with a low surface energy, the contact angle of pure water decreases to 85° or less after abrasion. To maintain such a low surface energy even after abrasion of the surface of the photoconductor, the bulk of the surface top layer is required to be filled with such a low-surface energy unit.

In the present invention, the contact angle which pure water makes with the surface of the photoconductor is measured after the photoconductor is abraded with a depth of about 1 μm from the outermost surface. This is because the contact angle becomes constant after the surface of the photoconductor is abraded to the extent mentioned above. In practice, the contact angle of pure water may be measured on the surface of the photoconductor after the surface is abraded with a depth of 1±0.3 μm. To measure the above-mentioned contact angle, a photoconductor is incorporated in a commercially available copying machine and the surface of the photoconductor is caused to wear away by rubbing to the above-mentioned extent by continuous image formation.

Alternatively, the surface of the photoconductor may be intentionally scraped, for example, using a commercially available Taber abrader (made by Toyo Seiki Seisaku-sho, Ltd.). In this case, with a truck wheel CS-5 being placed in contact with the surface of the photoconductor, the photoconductor is scraped by 1,000 rotations at a rate of 60 rpm under the application of a load of 1000 g at 20° C. and 50% RH. The contact angle which pure water makes with the surface of the photoconductor can be measured by a sessile drop method using a commercially available measuring instrument "Automatic Contact Angle Meter CA-W" (trademark), made by KYOWA INTERFACE SCIENCE CO., LTD. In this measurement, it is preferable that the contact angle which pure water makes with the surface of the photoconductor be in the range of 85 to 140°, and more preferably 95 to 140°, when measured at the position of 1±0.3 μm inward from the outermost surface of the photoconductor.

Further, it is preferable that a sliding angle of pure water at which angle pure water starts sliding down the surface of the photoconductor be 65° or less. The sliding angle is herein used to evaluate the same physical properties as those conventionally defined by a falling angle. Conventionally, a decrease in surface energy of the photoconductor is physically evaluated by a friction coefficient and a contact angle which water makes with the surface of the photoconductor. However, a decrease in friction coefficient and an increase in water repellency of the surface of the photoconductor do not always have an effect on the improvement of durability of the photoconductor. Thus, the inventors of the present invention have found a scale by which ionic compounds generated by the charging step can be prevented from being accumulated on the surface of the photoconductor. The above-mentioned scale is a critical angle at which angle a water droplet on a surface starts sliding down, that is, a falling angle.

The sliding angle (or falling angle) can be easily obtained by taking advantage of an additional function of the above-mentioned contact angle meter. Since the sliding angle is a critical angle at which a water droplet starts sliding down a surface, the sliding angle varies depending upon the weight of the water droplet deposited on the surface. The heavier, the weight of a water droplet, or the larger the volume of a water droplet, the smaller the sliding angle. Therefore, it is necessary to measure the sliding angle under the same conditions in terms of the weight of a water droplet. In the present invention, the volume of a water droplet subjected to the measurement is adjusted to 15 to 20 ul.

It has been confirmed by the measurement that when the sliding angle of pure water on the surface of the photoconductor is more than 65°, image blurring easily occurs. A smaller sliding angle is assumed to have a more effect in preventing the surface of the photoconductor from being contaminated. However, when the sliding angle is smaller than 5°, the surface of the photoconductor becomes so slippery that a toner dot image cannot be reproduced from a latent image exactly. As a result, it is preferable that the sliding angle where pure water starts sliding down the surface of the photoconductor be in the range of 5 to 65°, and more preferably 5 to 35°. This data results from strict evaluation of the obtained toner image.

As previously mentioned, the relation between the sliding angle and the occurrence of image blurring has been clarified. This relation is considered to be applicable in designing the photoconductors. In this case, not only pure water, but also other organic solvents such as an alcohol solvent can be employed as a model of a contaminant deposited on the photoconductor.

FIG. 2 to FIG. 5 are cross sectional views showing embodiments of the electrophotographic photoconductor according to the present invention.

Figure 2:
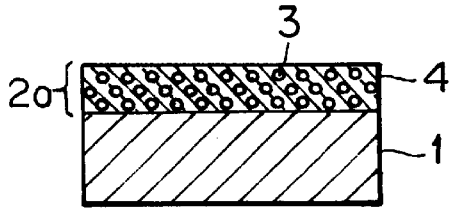
FIG. 2 is a schematic cross-sectional view of a first embodiment of an electrophotographic photoconductor according to the present invention.

A photoconductor shown in FIG. 2 is a single-layered photoconductor. In this photoconductor, there is formed a photoconductive layer 2*a* on an electroconductive support 1. The photoconductive layer 2*a* comprises (i) a charge transport medium 4 comprising at least one binder resin selected from the group consisting of the previously mentioned polyurethane resin, polyester resin, and polycarbonate resin, and (ii) a charge generation material 3 dispersed in the charge transport medium 4. In this embodiment, any other binder agents commonly used may be used in combination with the above-mentioned resins in order to improve the dispersion properties of a coating liquid for the photoconductive layer 2*a* and increase the strength of the obtained photoconductive layer 2*a*. In addition, a filler may also be contained in the photoconductive layer 2*a* when necessary.

The charge transport medium 4 comprises as a material capable of transporting electric charges the previously mentioned positive hole transporting material or electron transporting material. The charge generation material 3, which is, for example, an inorganic or organic pigment, generates charge carriers. The charge transport medium 4 accepts the charge carriers generated by the charge generation material 3 and transports those charge carriers.

In this electrophotographic photoconductor of FIG. 2, it is basically necessary that the light-absorption wavelength regions of the charge generation material 3 and the resins for use in the present invention not overlap in the visible light range. This is because, in order that the charge generation material 3 produce charge carriers efficiently, it is necessary that light pass through the charge transport medium 4 and reach the surface of the charge generation material 3.

Figure 3:
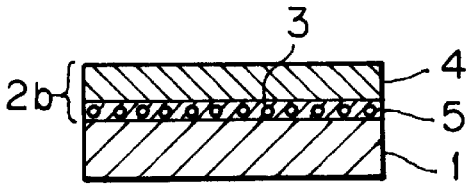
FIG. 3 is a schematic cross-sectional view of a second embodiment of an electrophotographic photoconductor according to the present invention.

Referring to FIG. 3, there is shown an enlarged cross-sectional view of a further embodiment of an electrophotographic photoconductor according to the present invention. In the figure, there is formed on an electroconductive support 1 a two-layered photoconductive layer 2*b* comprising a charge generation layer 5 containing a charge generation material 3, and a charge transport layer 4 comprising a charge transport medium. The charge transport medium comprises a material capable of transporting electric charges, such as the above-mentioned positive hole transporting material or electron transporting material. At least one of the above-mentioned resins for use in the present invention serves as a binder resin (or binder agent) in the charge transport medium. Such resins may be used in combination with any other resins and fillers for the same purposes as mentioned above.

In this photoconductor of FIG. 3, light which has passed through the charge transport layer 4 reaches the charge generation layer 5, and charge carriers are generated within the charge generation layer 5. The charge carriers which are necessary for light decay for latent electrostatic image formation are generated by the charge generation material 3, and accepted and transported by the charge transport layer 4.

Figure 4:
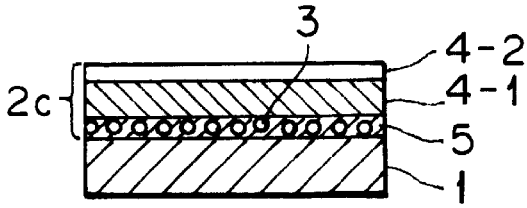
FIG. 4 is a schematic cross-sectional view of a third embodiment of an electrophotographic photoconductor according to the present invention.

FIG. 4 is a cross sectional view of still another embodiment of an electrophotographic photoconductor according to the present invention.

In this photoconductor, a photoconductive layer 2*c* comprises a charge generation layer 5, a first charge transport layer 4-1, and a second charge transport layer 4-2, with these layers being successively overlaid on an electroconductive support 1 in that order. The second charge transport layer 4-2 comprises as a binder resin at least one resin selected from the group consisting of the polyurethane, polyester, and polycarbonate resins. Any other resins and fillers may be further added to the second charge transport layer 4-2 for the same purposes as mentioned above.

Figure 5:
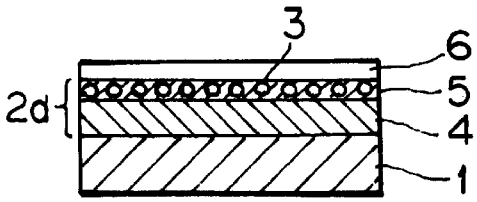
FIG. 5 is a schematic cross-sectional view of a fourth embodiment of an electrophotographic photoconductor according to the present invention.

Referring to FIG. 5, there is shown still another embodiment of an electrophotographic photoconductor according to the present invention. In this figure, the overlaying order of the charge generation layer 5 and the charge transport layer 4 is reversed in view of the electrophotographic photoconductor shown in FIG. 3. The mechanism of generation and transportation of the charge carriers is substantially the same as that of the photoconductor shown in FIG. 3. In this case, a protective layer 6 comprising at least one of the previously mentioned resins for use in the present invention is formed on the charge generation layer 5. The protective layer 6 may further comprise any other resins and fillers.

In any of the photoconductors shown in FIG. 2 to FIG. 5, an undercoat layer (not shown) may be provided between the electroconductive support 1 and the photoconductive layer 2*a*, 2*b*, 2*c*, or 2*d* to improve the charging characteristics of the photoconductive layer, to increase the adhesion between the electroconductive support and the photoconductive layer, and prevent the occurrence of Moiré caused by coherent beams of light such as a laser beam for data recording.

To prepare the electroconductive support 1 for use in the electrophotographic photoconductor, an electroconductive material with a volume resistivity of $10^{10}$ Ω or less, for example, a metal such as aluminum, nickel, chromium, nichrome, copper, silver, gold, platinum, or iron; or a metallic oxide such as tin oxide or indium oxide is coated by deposition or sputtering on a supporting material, e.g., a plastic film or a sheet of paper, which may be fabricated in a cylindrical form. Alternatively, a plate of aluminum, aluminum alloy, nickel or stainless steel can be used as the electroconductive support 1, and the above-mentioned metal plate may be made into a tube by extrusion or pultrusion and subjected to surface treatment such as cutting, superfinishing and grinding.

For the purpose of improving the mechanical durability, the charge transport layer may further comprise any other resins than the previously mentioned polyurethane resin, polyester resin, and polycarbonate resin. It is preferable that the charge transport layer for use in the present invention transmit a monochromatic light with a wavelengths in the range of 390 to 460 nm, as previously mentioned. In consideration of this, it is desirable to employ binder resins which allow light within the above-mentioned wavelength region to pass through in a similar manner of the previously mentioned polyurethane, polyester, and polycarbonate resins. For example, the following thermoplastic resins and thermosetting resins are preferably used: polystyrene, styrene acrylonitrile copolymer, styrene-butadiene copolymer, styrene-maleic anhydride copolymer, polyester, poly(vinyl chloride), vinyl chloride-vinyl acetate copolymer, poly (vinyl acetate), poly(vinylidene chloride), polyallylate, phenoxy resin, polycarbonate resin, cellulose acetate resin, ethyl cellulose resin, poly(vinyl butyral), poly(vinyl formal), poly (vinyltoluene), poly-N-vinylcarbazole, acrylic resin, silicone resin, epoxy resin, melamine resin, urethane resin, phenolic resin, and alkyd resin.

The charge transport layer for use in the present invention may further comprise a plasticizer and a leveling agent.

Any plasticizers that are contained in the general-purpose resins, such as halogenated paraffin, dimethyl-naphthalene, dibutyl phthalate, and dioctyl phthalate can be used as it is. It is proper that the amount of plasticizer be in the range of 0 to about 30 wt. % of the total weight of the binder resins for use in the present invention such as polyurethane resin, polyester resin, and polycarbonate resin.

As the leveling agent for use in the charge transport layer, there can be employed silicone oils such as dimethyl silicone oil and methylphenyl silicone oil, and polymers and oligomers having a perfluoroalkyl group on the side chain thereof. The proper amount of leveling agent is at most about 1 wt. % of the total weight of the binder resins for use in the present invention such as polyurethane resin, polyester resin, and polycarbonate resin.

The charge transport layer can be formed by coating methods such as dip coating, spray coating, ring coating, roll coating, gravure coating, and nozzle coating.

It is preferable that the thickness of the charge transport layer 4 or first charge transport layer 4-1 be in the range of about 3 to about 50 μm. The thickness of the second charge transport layer 4-2 may be in the range of 0.15 to 10 μm, preferably 0.5 to 5 μm.

Specific examples of the charge generation material 3 for use in the present invention are as follows: inorganic materials such as selenium, selenium-tellurium, cadmium sulfide, cadmium sulfide-selenium, and α-silicon (amorphous silicon); and organic materials, for example, azo pigments, such as C.I. Pigment Blue 25 (C.I. 21180), C.I. Pigment Red 41 (C.I. 21200), C.I. Acid Red 52 (C.I. 45100), C.I. Basic Red 3 (C.I. 45210), an azo pigment having a carbazole skeleton (Japanese Laid-Open Patent Application 53-95033), an azo pigment having a distyryl benzene skeleton (Japanese Laid-Open Patent Application 53-133445), an azo pigment having a triphenylamine skeleton (Japanese Laid-Open Patent Application 53-132347), an azo pigment having a dibenzothiophene skeleton (Japanese Laid-Open Patent Application 54-21728), an azo pigment having an oxadiazole skeleton (Japanese Laid-Open Patent Application 54-12742), an azo pigment having a fluorenone skeleton (Japanese Laid-Open Patent Application 54-22834), an azo pigment having a bisstilbene skeleton (Japanese Laid-Open Patent Application 54-17733), an azo pigment having a distyryl oxadiazole skeleton (Japanese Laid-Open Patent Application 54-2129), and an azo pigment having a distyryl carbazole skeleton (Japanese Laid-Open Patent Application 54-14967); phthalocyanine pigments such as C.I. Pigment Blue 16 (C.I. 74100); indigo pigments such as C.I. Vat Brown 5 (C.I. 73410) and C.I. Vat Dye (C.I. 73030); and perylene pigments such as Algol Scarlet B and Indanthrene Scarlet R (made by Bayer Co., Ltd.). These charge generation materials may be used alone or in combination.

Of the above-mentioned charge generation materials, a phthalocyanine pigment is particularly preferable to obtain an electrophotographic photoconductor with high sensitivity and high durability.

As the phthalocyanine pigment, a compound having a phthalocyanine skeleton represented by the following formula (5) can be employed.

(5)

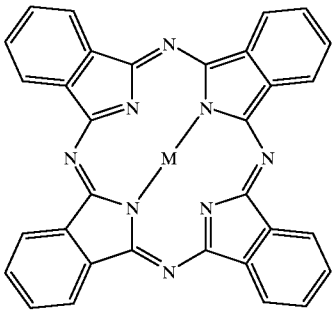

To be more specific, as the central atom (M) in the above formula (5), there can be employed a hydrogen atom (H) or metal atoms such as Li, Be, Na, Mg, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, Sb, Ba, Hf, Ta, W, Re, Os, Ir, Pt, Au, Hg, Tl, La, Ce, Pr, Nd, Pm, Sm, Eu, Gd, Tb, Dy, Ho, Er, Tm, Yb, Lu, Th, Pa, U, Np, and Am; and the combination of atoms forming an oxide, chloride, fluoride, hydroxide, or bromide. The central atom is not limited to the above-mentioned atoms.

The above-mentioned charge generation material with a phthalocyanine skeleton for use in the present invention may have at least the basic structure as indicated by the above-mentioned formula (5). Therefore, the charge generation material may have a dimer structure or trimer structure, and further, a polymeric structure. Further, the above-mentioned basic structure of the above formula (5) may have a substituent.

Of such phthalocyanine compounds, an oxotitanium phthalocyanine compound which has the central atom (M) of TiO in the above-mentioned formula (5), and a metal-free phthalocyanine compound which has a hydrogen atom as the central atom (M) are particularly preferred in light of the photoconductive properties of the obtained photoconductor.

In addition, it is known that each phthalocyanine compound has a variety of crystal systems. For example, the above-mentioned oxotitanium phthalocyanine has crystal systems of α-type, β-type, γ-type, m-type, and y-type. In the case of copper phthalocyanine, there are crystal systems of α-type, β-type, and γ-type. The properties of the phthalocyanine compound vary depending on the crystal system thereof although the central metal atom is the same. According to "Electrophotography -the Society Journal- Vol. 29, No. 4 (1990)", it is reported that the properties of the photoconductor vary depending on the crystal system of a phthalocyanine contained in the photoconductor. It is therefore important to select the optimal crystal system of each phthalocyanine compound to obtain the desired photoconductive properties. The oxotitanium phthalocyanine with the y-type crystal system is particularly advantageous.

A plurality of charge generation materials with phthalocyanine skeleton may be used in combination in the charge generation layer.

To provide the charge generation layer, a charge generation material, with a binder agent being optionally added thereto, is dissolved or dispersed in a proper solvent to prepare a coating liquid for charge generation layer. The coating liquid thus prepared may be coated by casting method and dried.

Any conventional binder resins having high electrical insulating properties are suitable as the binder resins for use in the charge generation layer. Specific examples of such binder resins for use in the charge generation layer include addition polymerization resins, polyaddition resins, and polycondensation resins, such as polyethylene, poly(vinyl butyral), poly(vinyl formal), polystyrene resin, phenoxy resin, polypropylene, acrylic resin, methacrylic resin, vinyl chloride resin, vinyl acetate resin, epoxy resin, polyurethane resin, phenolic resin, polyester resin, alkyd resin, polycarbonate resin, polyamide resin, silicone resin, and melamine resin. Further, there can be employed copolymer resins comprising two or more repetition units of the above-mentioned resins, for example, electrical insulating resins such as vinyl chloride—vinyl acetate copolymer, styrene—acrylic copolymer, and vinyl chloride—vinyl acetate—maleic anhydride copolymer; and high-molecular weight organic semiconductor such as poly-N-vinylcarbazole. These binder agents may be used alone or in combination.

It is preferable that the amount of the binder resin for use in the charge generation layer be in the range of 0 to 5 parts by weight, preferably 0.1 to 3 parts by weight, with respect to one part by weight of the charge generation material.

Examples of the solvent used to prepare a coating liquid for charge generation layer include N,N-dimethylformamide, toluene, xylene, monochlorobenzene, 1,2-dichloroethane, 1,1,1-trichloroethane, dichloromethane, 1,1,2-trichloroethane, trichloroethylene, tetrahydrofuran, methyl ethyl ketone, methyl isobutyl ketone, cyclohexanone, ethyl acetate, butyl acetate, and dioxane.

For preparing a dispersion of a coating liquid for charge generation layer, a ball mill, ultrasonic dispersion mill, homomixer, attritor, sand mill, or the like can be used. The coating liquid for charge generation layer may be coated by dip coating, blade coating, spray coating, or bead coating.

When the charge generation material is dispersed to prepare the photoconductive layer, it is preferable that the mean particle diameter of the charge generation material be 2 μm or less, and more preferably 1 μm or less, to promote the dispersion properties of the charge generation material in the layer. However, when the mean particle diameter of the charge generation material is excessively small, the fine particles tend to aggregate, which will increase the resistivity of the obtained layer and increase defective crystals. As a result, the sensitivity and the repetition properties will deteriorate. In consideration of the limitation in pulverizing, the lower limit of the mean particle diameter of the charge generation material is preferably 0.01 μm.

It is preferable that the charge generation layer have a thickness of about 0.01 to about 5 μm, and more preferably 0.1 to 2 μm.

The charge generation layer 5 can be formed on the electroconductive support 1 by casting method using the above-mentioned dispersion system, or vacuum thin-film forming method. The vacuum thin-film forming method includes vacuum deposition, glow discharge, ion plating, sputtering, reactive sputtering, and chemical vapor deposition (CVD).

In any case, the charge generation layer thus formed may be subjected to machine polishing and adjustment of the thickness.

The electrophotographic photoconductor shown in FIG. 2 can be produced by the following method. Finely-divided particles of a charge generation material 3 are dispersed in a solution where a charge transport material and at least one resin selected from the group consisting of the polyurethane, polyester, and polycarbonate resins for use in the present invention are dissolved, optionally in combination with any other binder agents. A filler may be dispersed in the solution when necessary. A coating liquid for photoconductive layer 2*a* thus prepared is coated on an electroconductive support 1 and then dried, whereby a photoconductive layer 2*a* is provided on the electroconductive support 1.

It is preferable that the thickness of the photo-conductive layer 2*a* be in the range of 3 to 100 μm, more preferably in the range of 5 to 40 μm.

It is preferable that the amount of the polyurethane, polyester, and/or polycarbonate resin for use in the present invention be in the range of 40 to 90 wt. %, and more preferably 40 to 80 wt. %, of the total weight of the photoconductive layer 2*a*. It is preferable that the amount of the charge generation material 3 for use in the photoconductive layer 2*a* be in the range of 0.1 to 50 wt. %, more preferably in the range of 1 to 20 wt. % of the total weight of the photoconductive layer 2*a*.

In the photoconductive layer 2*a*, a plurality of charge transport materials may be used in combination.

The electrophotographic photoconductor shown in FIG. 3 can be produced by the following method. A charge generation layer 5 is first provided on an electroconductive support 1. A coating liquid for charge transport layer 4 is then prepared by dissolving a charge transport material (a positive hole transporting material or an electron transporting material) and at least one resin selected from the above-mentioned group, optionally in combination with any other binder agents, in a proper solvent. Finely-divided particles of a filler may be further dispersed in the above prepared coating liquid for charge transport layer 4. The coating liquid thus prepared is coated on the charge generation layer 5 and dried, so that a charge transport layer 4 is formed on the charge generation layer 5.

The thickness of the charge generation layer 5 in FIG. 3 is generally in the range of 0.01 to 5 μm, preferably in the range of 0.1 to 2 μm. It is preferable that the thickness of the charge transport layer 4 be in the range of 3 to 50 μm, more preferably in the range of 5 to 40 μm.

In the charge generation layer 5 where finely-divided particles of the charge generation material 3 are dispersed in a binder agent, it is preferable that the amount of finely-divided particles of the charge generation material 3 for use in the charge generation layer 5 be in the range of 10 to 100 wt. %, more preferably in the range of about 50 to 100 wt. % of the total weight of the charge generation layer 5. It is preferable that the amount of the polyurethane, polyester, and/or polycarbonate resin for use in the present invention be in the range of 40 to 90 wt. % of the total weight of the charge transport layer 4.

To produce a photoconductor shown in FIG. 4, the first charge transport layer 4-1 is provided on the electroconductive support 1. Then, a mixture of the charge transport material and the polyurethane, polyester, and/or polycarbonate resin for use in the present invention is dissolved optionally in combination with any other binder agents, so that a coating liquid for charge transport layer 4-2 is prepared. The coating liquid thus prepared is coated on the charge transport layer 4-1 and dried, whereby a charge transport layer 4-2 is provided. When necessary, finely-divided particles of a filler may be added to the above-mentioned coating liquid for charge transport layer 4-2.

It is preferable that the thickness of the first charge transport layer 4-1 be in the range of 3 to 50 μm, and more preferably 5 to 40 μm. It is preferable that the thickness of the second charge transport layer 4-2 be in the range of 0.15 to 10 μm, more preferably 1 to 10 μm.

The total amount of resins such as polyurethane resin, polyester resin, and polycarbonate resin for use in the second charge transport layer 4-2 is preferably in the range of 40 to 100 wt. %, and more preferably in the range of 40 to 90 wt. % of the total weight of the second charge transport layer 4-2.

To produce the electrophotographic photoconductor shown in FIG. 5, a charge transport layer 4 and a charge generation layer 5 are successively formed on an electroconductive support 1 in this order. The amount ratios of components for use in the charge transport layer 4 and the charge generation layer 5 are the same as mentioned in the description of FIG. 3. A protective layer 6 is provided on the charge generation layer 5, using the polyurethane resin, polyester resin, and/or polycarbonate resin for use in the present invention.

A coating liquid for protective layer 6 comprises the above-mentioned polyurethane resin, polyester resin, and/or polycarbonate resin, optionally in combination with finely-divided particles of a filler and any other resins. In this case, the same filler that can be used in the photoconductive layer, and the same resins as used in the charge transport layer, can be employed.

It is preferable that the thickness of the protective layer 6 be in the range of 0.15 to 10 μm, and more preferably 1 to 10 μm. It is preferable that the amount of the resin for use in the present invention such as polyurethane resin, polyester resin, and/or polycarbonate resin be in the range of 40 to 100 wt. %, and more preferably 40 to 90 wt. %, of the total weight of the protective layer 6.

In any case, when the coating liquid comprises finely-divided particles of a filler, the following dispersion medium is preferably employed: ketones such as methyl ethyl ketone, acetone, methyl isobutyl ketone, and cyclohexanone; ethers such as dioxane, tetrahydrofuran, and ethyl cellosolve; aromatic solvents such as toluene and xylene; halogenated solvents such as chlorobenzene and dichloromethane; and esters such as ethyl acetate and butyl acetate. The coating liquid may be subjected to dispersion and pulverizing using a ball mill, sand mill, or oscillating mill. Any coating liquid that contains the filler particles may be coated by dip coating, spray coating, ring coating, roll coating, gravure coating, or nozzle coating.

The electrophotographic photoconductor of the present invention may further comprise an undercoat layer which is interposed between the electroconductive support and the photoconductive layer. The undercoat layer is provided in order to improve the adhesion between the electroconductive support and the photoconductive layer, prevent the occurrence of Moiré fringe, improve the coating characteristics, and reduce the residual potential.

The undercoat layer comprises a resin as the main component. Since the photoconductive layer is provided on the undercoat layer by coating method using a solvent, it is desirable that the resin for use in the undercoat layer have high resistance against general-purpose organic solvents.

Preferable examples of the resin for use in the undercoat layer include water-soluble resins such as poly(vinyl alcohol), casein, and sodium polyacrylate; alcohol-soluble resins such as copolymer nylon and methoxymethylated nylon; and hardening resins with three-dimensional network such as polyurethane, melamine resin, alkyd-melamine resin, and epoxy resin.

To effectively prevent the occurrence of Moiré and obtain an optimum resistivity, the undercoat layer may further comprise finely-divided particles of metallic oxides such as titanium oxide, silica, alumina, zirconium oxide, tin oxide, and indium oxide; metallic sulfides; or metallic nitrides.

Similar to the photoconductive layer, the undercoat layer can be provided on the electroconductive support by a coating method, using an appropriate solvent.

Further, the undercoat layer for use in the present invention may be a metallic oxide layer prepared by the sol-gel processing using a coupling agent such as silane coupling agent, titanium coupling agent, or chromium coupling agent.

Furthermore, to prepare the undercoat layer, $Al_2O_3$ may be deposited on the electroconductive support by the anodizing process, or an organic material such as polyparaxylylene (parylene), or inorganic materials such as SiO, $SnO_2$, $TiO_2$, ITO, and $CeO_2$ may be deposited on the electroconductive support by vacuum thin-film forming method.

It is preferable that the thickness of the undercoat layer be in the range of 0.01 to 20 μm, more preferably 0.05 to 15 μm, and further preferably 0.05 to 5 μm.

Furthermore, in the present invention, phenol compounds, hydroquinone compounds, hindered phenol compounds, hindered amine compounds, compounds having both a hindered amine and a hindered phenol in a molecule may be preferably employed in the photoconductive layer for the improvement of charging characteristics.

In the electrophotographic photoconductor of the present invention, an antioxidant may also be contained in any layer that contains an organic material therein in order to improve the environmental resistance, to be more specific, to prevent the decrease of photosensitivity and the increase of residual potential. In particular, satisfactory results can be obtained when the antioxidant is added to the layer which comprises the charge transport material.

Specific examples of the antioxidants for use in the present invention are as follows:

(1) Monophenol compounds:
2,6-di-t-butyl-p-cresol, butylated hydroxyanisole, 2,6-di-t-butyl-4-ethylphenol, and stearyl-β-(3,5-di-t-butyl-4-hydroxyphenyl)propionate.

(2) Bisphenol compounds:
2,2'-methylene-bis-(4-methyl-6-t-butylphenol), 2,2'-methylene-bis-(4-ethyl-6-t-butylphenol), 4,4'-thiobis-(3-methyl-6-t-butylphenol), and 4,4'-butylidenebis-(3-methyl-6-t-butylphenol).

(3) Polymeric phenol compounds:
1,1,3-tris-(2-methyl-4-hydroxy-5-t-butylphenyl) butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, and tocopherol.

(4) Paraphenylenediamine compounds:
N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

(5) Hydroquinone compounds:
2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

(6) Organic sulfur-containing compounds:
dilauryl-3,3'-thiodipropionate, distearyl-3,3'-thiodipropionate, and ditetradecyl-3,3'-thiodipropionate.

(7) Organic phosphorus-containing compounds:
triphenylphosphine, tri(nonylphenyl)phosphine, tri(dinonylphenyl)phosphine, tricresylphosphine, and tri(2,4-dibutylphenoxy)phosphine.

The above-mentioned compounds (1) to (7) are commercially available as the antioxidants for rubbers, plastic materials, and fats and oils.

It is preferable that the amount of antioxidant be in the range of 0.01 to 100 parts by weight, more preferably 0.1 to 30 parts by weight, with respect to 100 parts by weight of the charge transport material.

According to the electrophotographic image forming method using the photoconductor of the present invention, the surface of the photoconductor is uniformly charged to a predetermined polarity in the dark. The uniformly charged photoconductor is exposed to a light image so that a latent electrostatic image is formed on the surface of the photoconductor. The thus formed latent electrostatic image is developed as a visible image by a developer, and the developed image is transferred to a sheet of paper when necessary.

The electrophotographic image forming apparatus of the present invention comprises the previously mentioned photoconductor, charging means, light exposure means, development means, and image transfer means.

The process cartridge of the present invention holds therein the aforementioned photoconductor and at least one means of the charging means, light exposure means, development means, image transfer means, or cleaning means. The process cartridge is freely attachable to the main body of the image forming apparatus, and detachable therefrom.

The electrophotographic image forming apparatus and method, and the process cartridge according to the present invention will now be explained in detail with reference to FIG. 6 to FIG. 8.

Figure 6:
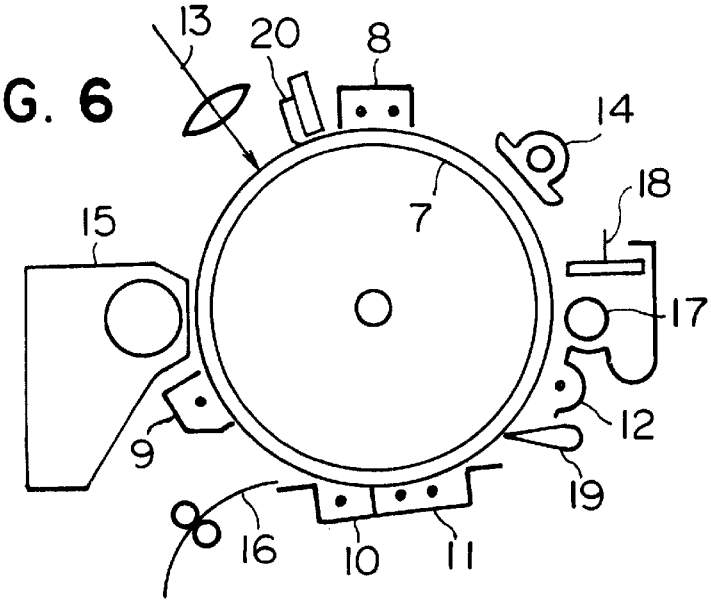
FIG. 6 is a schematic diagram in explanation of an embodiment of an electrophotographic image forming method and apparatus according to the present invention.

FIG. 6 is a schematic view which shows one embodiment of the electrophotographic image forming method and apparatus employing the electrophotographic photoconductor according to the present invention.

In FIG. 6, an electrophotographic photoconductor 7 according to the present invention is in the form of a drum.

The photoconductor may be in the form of a drum as shown in FIG. 6, or a sheet or an endless belt.

As shown in FIG. 6, a charger 8, an eraser 20, a light exposure unit 13, a development unit 15, a pretransfer charger 9, an image transfer charger 10, a separating charger 11, a separator 19, a pre-cleaning charger 12, a fur brush 17, a cleaning blade 18, and a quenching lamp 14 are disposed around the drum-shaped electrophotographic photoconductor 7.

The charger 8, the pre-transfer charger 9, the image transfer charger 10, the separating charger 11, and the pre-cleaning charger 12 may employ the conventional means such as a corotron charger, a scorotron charger, a solid state charger, and a charging roller. For the image transfer means, it is effective to employ both the image transfer charger 10 and the separating charger 11 as illustrated in FIG. 6.

As the light sources for the light exposure unit 13 and the quenching lamp 14, there can be employed, for example, a fluorescent tube, tungsten lamp, halogen lamp, mercury vapor lamp, sodium light source, light emitting diode (LED), semiconductor laser (LD), and electroluminescence (EL). In particular, the LD or LED with wavelengths of 400 to 450 nm is preferably employed as the light source for the light exposure unit 13. In such a case, it is preferable that the light source for image exposure, that is, the light source for data recording, have a beam diameter of 10 to 30 $\mu$m to realize high resolution of 1200 to 2400 dpi. Further, a desired wavelength can be selectively extracted by use of various filters such as a sharp-cut filter, bandpass filter, a near infrared cut filter, dichroic filter, interference filter, and color conversion filter.

The photoconductor may be irradiated with light in the course of the image transfer step, quenching step, cleaning step, or pre-light-exposure step. In such a case, the above-mentioned light sources are usable.

The toner image formed on the photoconductor 7 using the development unit 15 is transferred to a transfer sheet 16. At the step of image transfer, all the toner particles deposited on the photoconductor 7 are not transferred to the transfer sheet 16. Some toner particles remain on the surface of the photoconductor 7. The remaining toner particles are removed from the photocotductor 7 using the fur brush 17 and the cleaning blade 18. The cleaning of the photoconductor may be carried out only by use of a cleaning brush. As the cleaning brush, there can be employed a conventional fur brush and magnetic fur brush.

When the photoconductor 7 is positively charged, and exposed to light images, positive electrostatic latent images are formed on the photoconductor 7. In the similar manner as in above, when a negatively charged photoconductor is exposed to light images, negative electrostatic latent images are formed. A negative toner and a positive toner are respectively used for development of the positive electrostatic images and the negative electrostatic images, thereby obtaining positive images. In contrast to this, when the positive electrostatic images and the negative electrostatic images are respectively developed using a positive toner and a negative toner, negative images can be obtained on the surface of the photoconductor 7. Not only such development means, but also the quenching means may employ the conventional manner.

Figure 7:
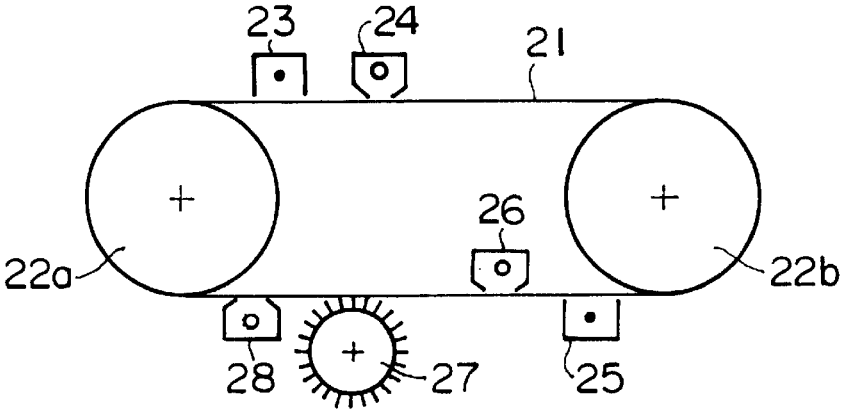
FIG. 7 is a schematic diagram in explanation of another embodiment of an electrophotographic image forming method and apparatus according to the present invention.

FIG. 7 is a schematic view which shows another embodiment of the electrophotographic image forming method and apparatus according to the present invention.

A photoconductor 21 shown in FIG. 7 according to the present inveniton, in the form of an endless belt, is driven by driving rollers 22*a* and 22*b*. Charging of the photoconductor 21 is carried out by use of a charger 23, and the charged photoconductor 21 is exposed to light images using an image exposure light 24. Thereafter, latent electrostatic images formed on the photoconductor 21 are developed to toner images using a development unit (not shown), and the toner images are transferred to a transfer sheet with the aid of a transfer charger 25. After the toner images are transferred to the transfer sheet, the photoconductor 21 is subjected to pre-cleaning light exposure using a pre-cleaning light 26, and physically cleaned by use of a cleaning brush 27. Finally, quenching is carried out using a quenching lamp 28. In FIG. 7, the electroconductive support of the photoconductor 21 has light transmission properties, so that it is possible to apply the pre-cleaning light 26 to the electroconductive support side of the photoconductor 21.

As a matter of course, the photoconductive layer side of the photoconductor 21 may be exposed to the pre-cleaning light. Similarly, the image exposure light 24 and the quenching lamp 28 may be disposed so that light is directed toward the electroconductive support side of the photoconductor 21.

The photoconductor 21 is exposed to light using the image exposure light 24, the pre-cleaning light 26, and the quenching lamp 28, as illustrated in FIG. 7. In addition to the above, light exposure may be carried out before image transfer, and before image exposure.

The above-discussed units, such as the charging unit, light exposure unit, development unit, image transfer unit, cleaning unit, and quenching unit may be fixedly incorporated in the copying machine, facsimile machine, or printer. Alternatively, at least one of those units may be incorporated in a process cartridge together with the photoconductor. To be more specific, the process cartridge may hold therein a photoconductor, and at least one of the charging unit, light exposure unit, development unit, image transfer unit, cleaning unit, or quenching unit, and the process cartridge may by detachably set in the above-mentioned electrophotographic image forming apparatus.

Figure 8:
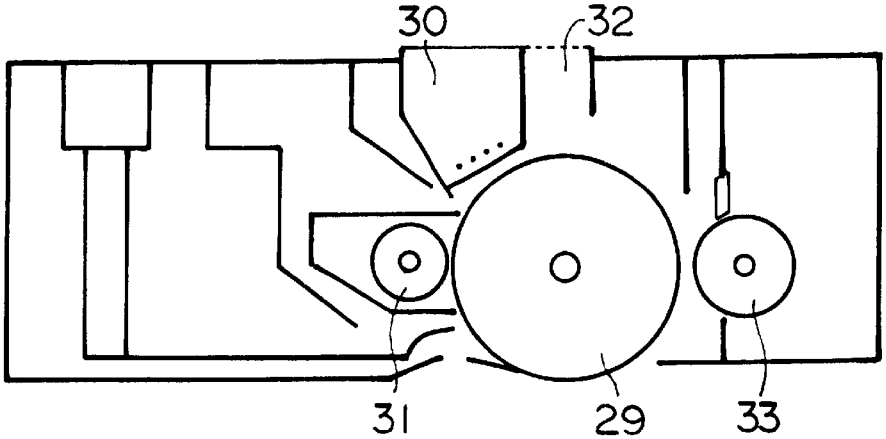
FIG. 8 is a schematic diagram in explanation of an example of a process cartridge according to the present invention.

FIG. 8 is a schematic view which shows one example of the process cartridge according to the present invention. In this embodiment of FIG. 8, there are disposed a charger 30, a light exposure unit 32, a development roller 33, and a cleaning brush 31 around a photoconductor 29.

A long-chain alkyl group containing bisphenol compound according to the present invention is represented by the following formula (2):

(2)

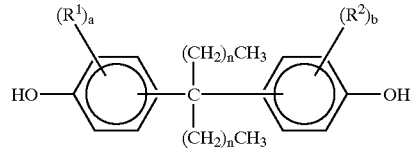

wherein $R^1$ and $R^2$ are each a halogen atom, a substituted or unsubstituted alkyl group having 1 to 6 carbon atoms, a substituted or unsubstituted alkoxyl group having 1 to 6 carbon atoms, or a substituted or unsubstituted aryl group; a and b are each an integer of 0 to 4; and n is an integer of 9 to 15.

In formula (2), when a and b are each an integer of 2 or more, a plurality of groups represented by $R^1$ or $R^2$ may be the same or different.

The bisphenol compound of formula (2) includes two long-chain alkyl groups in its molecule, with the chain lengths of the two alkyl groups being the same. This bisphenol compound can be synthesized from a phenol and a long-chain alkyl ketone in the presence of concentrated hydrochloric acid or hydrogen chloride, with the amount of phenol being twice the amount of the long-chain alkyl ketone. Such synthesis is conventionally known, for example, as described in Nippon Kagaku Kaishi, 1982, No. 8, p.1363.

The synthesis reaction of the long-chain alkyl group containing bisphenol compound of formula (2) is shown below.

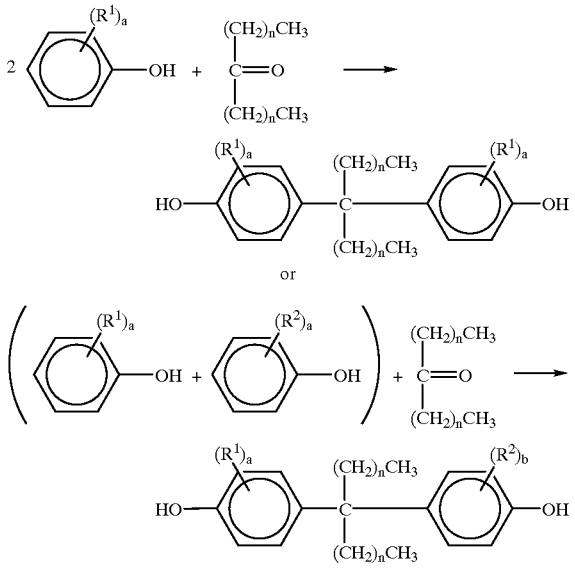

The reactivity is low although the reaction in the above is carried out by one step. Therefore, an optimal reaction temperature, reaction time, and catalyst to be employed may be selected. For instance, it is preferable to set the reaction temperatures in the range of 20 to 110° C., more preferably 50 to 80° C. When a catalyst is necessary, 3-mercaptopropionic acid or the like is preferably employed.

The novel bisphenol compound of formula (2) thus obtained is provided with excellent light resistance, and therefore, effectively serves as a light stabilizer. Further, this compound is useful not only as a monomer, but also as a raw material for preparing a polymer with water repellency.

Excellent water repellency of the compound of formula (2) results from the two long-chain alkyl groups in a molecule of the compound. Further, the symmetrical long-alkyl groups can maintain the balance from the viewpoint of molecular level, thereby imparting thermal stability to the obtained compound. In the above-mentioned formula (2), the water repellency of the obtained compound becomes poor when n is an integer of 8 or less, while the melting point unfavorably decreases when n is an integer of 16 or more.

The present invention also provides a polymer comprising a structural unit of the following formula (3):

(3)

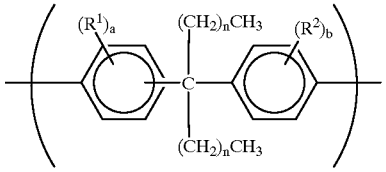

wherein $R^1$ and $R^2$ are each a halogen atom, a substituted or unsubstituted alkyl group having 1 to 6 carbon atoms, a substituted or unsubstituted alkoxyl group having 1 to 6 carbon atoms, or a substituted or unsubstituted aryl group; a and b are each an integer of 0 to 4; and n is an integer of 9 to 15.

The above-mentioned polymer has a novel skeleton. Because of symmetrical arrangement of two long-chain alkyl groups in a molecule of the polymer, the water repellency of the polymer is superior to that of the conventional long-chain alkyl group containing polymers. The polymer such as the previously mentioned polyurethane resin, polyester resin, or polycarbonate resin can be prepared from the above-mentioned bisphenol compound of formula (2) by a conventional synthesis method. A variety of polymers with desired properties in terms of water repellency can be synthesized by choosing the appropriate monomers for copolymerization. These properties can last long because the polymers of the present invention do not show surface orientation unlike silicone polymers. The polymers of the present invention can work as binder resins when used in a photoconductor as mentioned above. Further, wide-range applications of the polymer can be expected.

Other features of this invention will become apparent in the course of the following description of exemplary embodiments, which are given for illustration of the invention and are not intended to be limiting thereof.

PREPARATION EXAMPLE 1

[Preparation of compound of formula (2)]

19 parts by weight of phenol, 20 parts by weight of 14-heptacosanone, 13 parts by weight of concentrated hydrochloric acid, and 0.01 parts by weight of 3-mercaptopropionic acid were placed in a reactor with a stirrer, to cause a reaction at 80° C. for 20 hours.

After completion of the reaction, the reaction mixture was cooled and an organic layer was extracted therefrom by the addition of water and acetic acid. The organic layer was washed with water three times, and dried over anhydrous magnesium sulfate. The organic layer was filtered off, and a filtrate was concentrated. The resultant residue was chromatographed on silica gel and eluted with a mixed solvent of toluene and ethyl acetate (5/1). The resultant crystal was recrystallized from toluene, whereby 22 parts by weight of a bisphenol compound represented by formula (k) were obtained.

(k)

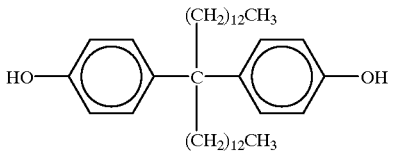

The melting point of this compound was 114.5 to 115.0° C.

The results of the elemental analysis of the obtained compound were as follows:

| | % C | % H |
|---|---|---|
| Found | 82.77 | 11.64 |
| Calculated | 82.92 | 11.42 |

PREPARATION EXAMPLES 2 and 3

[Preparation of compounds of formula (2)]

The procedure for preparation of the bisphenol compound of formula (k) in Preparation Example 1 was repeated except that 14-heptacosanone used in Preparation Example 1 was replaced by 11-heneicosanone and 17-tritriacontanone, respectively in Preparation Examples 2 and 3.

Thus, bisphenol compounds according to the present invention were prepared.

PREPARATION EXAMPLE 4

[Preparation of polycarbonate resin]

3.8 parts by weight of the bisphenol compound of formula (k) obtained in Preparation Example 1, 1.8 parts by weight of a bisphenol Z of which amount was equimolar to that of the bisphenol of formula (k) in terms of molar amounts, and 0.02 parts by weight of 4-tert-butyl phenol serving as a molecular weight modifier were placed in a reactor with a stirrer. An aqueous solution prepared by dissolving 4 parts by weight of sodium hydroxide and 0.2 parts by weight of sodium hydrosulfite in 40 parts by weight of water was added to the above reaction mixture and dissolved therein with stirring in a stream of nitrogen.

Thereafter, the reaction mixture was cooled to 20° C. With vigorously stirring the reaction mixture, a solution prepared by dissolving 2.4 parts by weight of bis(trichloromethyl) carbonate, namely, a trimer of phosgene, in 40 parts by weight of dichloromethane was added to the reaction mixture to cause a reaction as forming an emulsion.

After the reaction mixture was stirred at room temperature for 15 minutes, 0.01 parts by weight of triethylamine serving as a catalyst were added to the reaction mixture to cause a reaction with stirring at room temperature for 120 minutes.

Thereafter, 200 parts by weight of dichloromethane were added to the reaction mixture to separate an organic layer therefrom. The organic layer was successively washed with a 3% aqueous solution of sodium hydroxide, a 2% aqueous solution of hydrochloric acid, and water.

The resultant organic layer was added dropwise to a large quantity of methanol, whereby a white product was precipitated.

The thus precipitated product was dried, thereby obtaining a polycarbonate resin (Resin No. 1) according to the present invention, represented by the following formula:

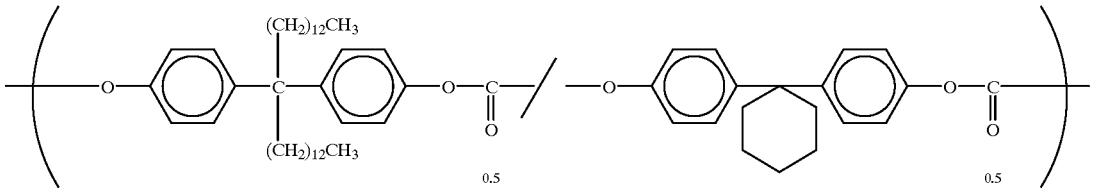

The polystyrene-reduced number-average molecular weight (Mn) and weight-average molecular weight (Mw) of the Resin No. 1, which were measured by the gel permeation chromatography, were respectively 77,500 and 198,700.

The glass transition temperature of the Resin No. 1 was 46.1° C. when measured with a differential scanning calorimeter.

The results of the elemental analysis of the obtained Resin No. 1 are as follows:

| | % C | % H |
|---|---|---|
| Found | 80.07 | 9.36 |
| Calculated | 80.05 | 9.11 |

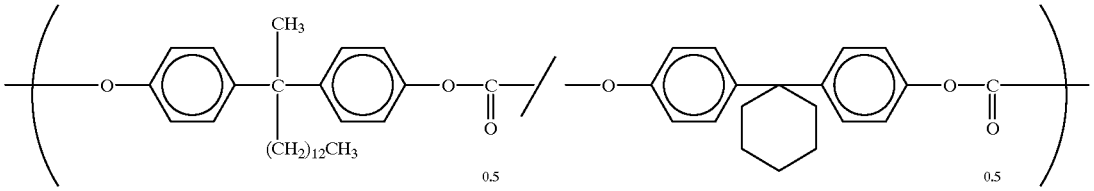

PREPARATION EXAMPLE 5

[Preparation of polycarbonate resin]

3.3 parts by weight of a bisphenol compound represented by the following formula (m), 2.2 parts by weight of a bisphenol Z of which amount was equimolar to that of the bisphenol of formula (m) in terms of molar amounts, and 0.04 parts by weight of 4-tert-butyl phenol serving as a molecular weight modifier were placed in a reactor with a stirrer. An aqueous solution prepared by dissolving 5 parts by weight of sodium hydroxide and 0.2 parts by weight of sodium hydrosulfite in 50 parts by weight of water was added to the above reaction mixture and dissolved therein with stirring in a stream of nitrogen.

(m)

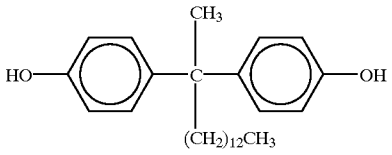

Thereafter, the reaction mixture was cooled to 20° C. With vigorously stirring the reaction mixture, a solution prepared by dissolving 3 parts by weight of bis(trichloromethyl) carbonate, namely, a trimer of phosgene, in 40 parts by weight of dichloromethane was added to the reaction mixture to cause a reaction as forming an emulsion.

After the reaction mixture was stirred at room temperature for 15 minutes, 0.01 parts by weight of triethylamine serving as a catalyst were added to the reaction mixture to cause a reaction at room temperature for 120 minutes with stirring.

Thereafter, 200 parts by weight of dichloromethane were added to the reaction mixture to separate an organic layer therefrom. The organic layer was successively washed with a 3% aqueous solution of sodium hydroxide, a 2% aqueous solution of hydrochloric acid, and water.

The resultant organic layer was added dropwise to a large quantity of methanol, whereby a white product was precipitated.

The thus precipitated product was dried, thereby obtaining a polycarbonate resin (Resin No. 2) according to the present invention, represented by the following formula:

The polystyrene-reduced number-average molecular weight (Mn) and weight-average molecular weight (Mw) of the Resin No. 2, which were measured by the gel permeation chromatography, were respectively 44,700 and 116,300.

The glass transition temperature of the Resin No. 2 was 71.3° C. when measured with a differential scanning calorimeter.

The results of the elemental analysis of the obtained Resin No. 2 are as follows:

| | % C | % H |
|---|---|---|
| Found | 78.59 | 8.02 |
| Calculated | 78.74 | 7.87 |

PREPARATION EXAMPLE 6

[Preparation of polyurethane resin]

In a stream of nitrogen, 5 parts by weight of 4,4'-decylidenebisphenol was dissolved in 25 ml of dried 1,3-dimethyl-2-imidazolidinone at 60 to 65° C.

A solution prepared by dissolving 2 parts by weight of 4,4'-diphenylmethane di-isocyanate in 10 ml of dried 1,3-dimethyl-2-imidazolidinone was added dropwise to the above prepared reaction mixture over a period of 15 minutes. The reaction mixture was then heated to 95 to 100° C. and stirred for 2 hours. With the addition of 0.05 parts by weight of dibutyl tin laurate serving as a catalyst, the reaction mixture was stirred for 2 hours. After that, stirring was further continued for 30 minutes with the addition of 0.08 parts by weight of a phenol.

The reaction mixture was cooled to room temperature, and added dropwise to 460 ml of methanol. The resultant precipitate was separated by filtration and washed with methanol. The reaction product thus obtained was dissolved in tetrahydrofuran and precipitated with methanol. Such a cycle of the consecutive two steps was repeated twice. Thus, there was obtained a polyurethane resin (Resin No. 3) according to the present invention, represented by the following formula:

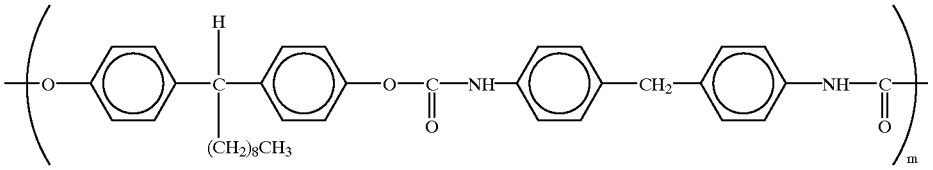

The polystyrene-reduced number-average molecular weight (Mn) and weight-average molecular weight (Mw) of the Resin No. 3, which were measured by the gel permeation chromatography, were respectively 10,790 and 12,900.

The results of the elemental analysis of the obtained Resin No. 3 are as follows:

| | % C | % H | % N |
|---|---|---|---|
| Found | 77.21 | 7.05 | 4.72 |
| Calculated | 77.06 | 6.99 | 4.36 |

PREPARATION EXAMPLE 7

[Preparation of polyester resin]

5 parts by weight of 4,4'-decylidenebisphenol was dissolved in 80 ml of a 2% aqueous solution of sodium hydroxide, and the thus prepared solution was placed in a reactor with a stirrer. While the solution was vigorously stirred on a water bath in a stream of nitrogen, a solution prepared by dissolving 2.2 parts by weight of terephthaloyl chloride in 60 ml of dried chloroform was added, thereby causing a polymerization reaction at 20° C. for 3 hours.

The resultant organic layer was separated from the reaction mixture, and washed with 350 parts by weight of water four times. The organic layer was added dropwise to acetone to obtain a polymer.

The polymer thus obtained was purified by dissolving the polymer in tetrahydrofuran, subjecting it to filtration, and adding the resultant residue dropwise to methanol to reprecipitate therewith. Such a purifying process was repeated three times, whereby a polyester resin (Resin No. 4) according to the present invention, represented by the following formula, was obtained:

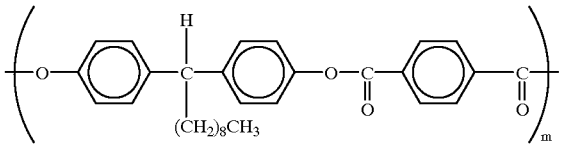

The polystyrene-reduced number-average molecular weight (Mn) and weight-average molecular weight (Mw) of the Resin No. 4, which were measured by the gel permeation chromatography, were respectively 15,400 and 26,900.

The results of the elemental analysis of the obtained Resin No. 4 are as follows:

| | % C | % H |
|---|---|---|
| Found | 78.80 | 7.03 |
| Calculated | 78.92 | 7.06 |

PREPARATION EXAMPLE 8

[Preparation of polycarbonate resin]

3.7 parts by weight of 4,4'-decylidenebisphenol compound and 0.03 parts by weight of 4-tert-butyl phenol serving as a molecular weight modifier were placed in a reactor with a stirrer. An aqueous solution prepared by dissolving 3.4 parts by weight of sodium hydroxide and 0.1 parts by weight of sodium hydrosulfite in 45 parts by weight of water was added to the above reaction mixture and dissolved therein with stirring in a stream of nitrogen.

Thereafter, the reaction mixture was cooled to 20° C. With vigorously stirring the reaction mixture, a solution prepared by dissolving 2 parts by weight of bis(trichloromethyl) carbonate, namely, a trimer of phosgene, in 30 parts by weight of dichloromethane was added to the reaction mixture to cause a reaction as forming an emulsion.

After the reaction mixture was stirred for 15 minutes, 0.01 parts by weight of triethylamine serving as a catalyst was added to the reaction mixture to cause a reaction with stirring at room temperature for 120 minutes.

Thereafter, 200 parts by weight of dichloromethane was added to the reaction mixture to separate an organic layer therefrom. The organic layer was successively washed with a 3% aqueous solution of sodium hydroxide, a 2% aqueous solution of hydrochloric acid, and water.

The resultant organic layer was added dropwise to a large quantity of methanol, whereby a white product was precipitated.

The thus precipitated product was dried, thereby obtaining a polycarbonate resin (Resin No. 5) according to the present invention, represented by the following formula:

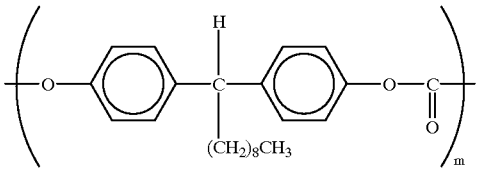

The polystyrene-reduced number-average molecular weight (Mn) and weight-average molecular weight (Mw) of the Resin No. 5, which were measured by the gel permeation chromatography, were respectively 65,300 and 141,000.

The results of the elemental analysis of the obtained Resin No. 5 are as follows:

| | % C | % H |
|---|---|---|
| Found | 78.55 | 8.19 |
| Calculated | 78.38 | 8.01 |

EXAMPLE 1

<Fabrication of Electrophotographic Photoconductor No. 1>

[Formation of undercoat layer]

A mixture of the following components was dispersed to prepare a coating liquid for undercoat layer:

| | Parts by Weight |
|---|---|
| Alkyd resin (Trademark "Beckosol 1307-60-EL", made by Dainippon Ink & Chemicals, Incorporated) | 6 |
| Melamine resin (Trademark "Super Beckamine G-821-60", made by Dainippon Ink & Chemicals, Incorporated) | 4 |
| Titanium oxide | 40 |
| Methyl ethyl ketone | 50 |

The thus prepared coating liquid was coated on the outer surface of an aluminum drum with a diameter of 30 mm and dried. Thus, an undercoat layer with a thickness of 3.5 μm on a dry basis was provided on the aluminum drum.

[Formation of charge generation layer]

A mixture of the following components was dispersed to prepare a coating liquid for charge generation layer:

| | Parts by Weight |
|---|---|
| Oxotitanium phthalocyanine pigment | 3 |
| Polyvinyl butyral (Trademark "XYHL", made by Union Carbide Japan K.K.) | 2 |
| Tetrahydrofuran | 95 |

The thus obtained coating liquid was coated on the above prepared undercoat layer and dried, so that a charge generation layer with a thickness of 0.2 μm was provided on the undercoat layer.

[Formation of charge transport layer]

The following components were mixed to prepare a coating liquid for charge transport layer:

| | Parts by Weight |
|---|---|
| Charge transport material with the following formula (a): | 7 |

-continued

| | Parts by Weight |
|---|---|
| (a) 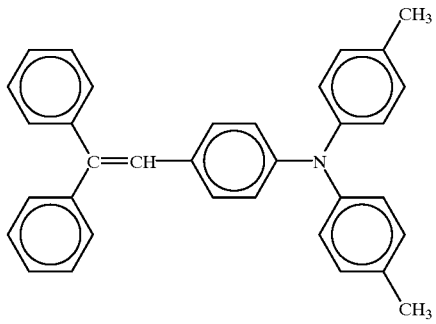 | |
| Polyurethane resin (Resin No. 3) prepared in Preparation Example 6 | 10 |
| Methylene chloride | 150 |

The thus prepared coating liquid was coated on the above prepared charge generation layer and dried, so that a charge transport layer with a thickness of 30±1 μm was provided on the charge generation layer.

Thus, an electrophotographic photoconductor No. 1 according to the present invention was fabricated.

EXAMPLE 2

The procedure for fabrication of the electrophotographic photoconductor No. 1 in Example 1 was repeated except that the polyurethane resin (Resin No. 3) used in the coating liquid for charge transport layer in Example 1 was replaced by the polyester resin (Resin No. 4) prepared in Preparation Example 7.

Thus, an electrophotographic photoconductor No. 2 according to the present invention was fabricated.

EXAMPLE 3

The procedure for fabrication of the electrophotographic photoconductor No. 1 in Example 1 was repeated except that the polyurethane resin (Resin No. 3) used in the coating liquid for charge transport layer in Example 1 was replaced by the polycarbonate resin (Resin No. 5) prepared in Preparation Example 8.

Thus, an electrophotographic photoconductor No. 3 according to the present invention was fabricated.

COMPARATIVE EXAMPLE 1

The procedure for fabrication of the electrophotographic photoconductor No. 1 in Example 1 was repeated except that the polyurethane resin (Resin No. 3) used in the coating liquid for charge transport layer in Example 1 was replaced by a commercially available bisphenol Z type polycarbonate (Trademark "PCX-5", made by Teijin Chemicals Ltd.)

Thus, a comparative electrophotographic photoconductor No. 1 was fabricated.

Each of the above obtained electrophotographic photoconductors No. 1 to No. 3 according to the present invention and comparative photoconductor No. 1 was set in a commercially available electrophotographic copying machine (Trademark "imagio MF200", made by Ricoh Company, Ltd.), and the photoconductor was charged and exposed to light images via original images to form latent electrostatic images thereon. The latent electrostatic images formed on the photoconductor were developed into visible toner images by a dry developer, and the visible toner images were transferred to a sheet of plain paper and fixed thereon. By making of 50,000 copies, image quality of the fixed toner image was evaluated.

The photoconductors according to the present invention produced high quality toner images after making of 50,000 copies. When a wet developer was employed for image formation, clear images were formed on the paper similarly.

In contrast to this, deterioration of image quality was observed when the comparative photoconductor was employed.

As previously explained, excellent image quality can be maintained by the electrophotographic method using the photoconductor of the present invention. The photoconductor of the present invention shows a minimum variation in the surface potential and therefore excels at durability and sensitivity.

EXAMPLE 4

<Fabrication of Electrophotographic Photoconductor No. 4>

[Formation of undercoat layer]

The following components were placed in a ball mill pot and subjected to ball milling for 48 hours together with alumina balls with a diameter of 10 mm, thereby preparing a coating liquid for undercoat layer:

| | Parts by Weight |
|---|---|
| Oil-free alkyd resin (Trademark "Beckolite M6401", made by Dainippon Ink & Chemicals, Incorporated) | 1.5 |
| Melamine resin (Trademark "Super Beckamine G-821", made by Dainippon Ink & Chemicals, Incorporated) | 1 |
| Titanium oxide (Trademark "Tipaque CR-EL" made by Ishihara Sangyo Kaisha, Ltd. | 5 |
| Methyl ethyl ketone | 22.5 |

The thus prepared coating liquid was coated on one surface of an aluminum plate and dried at 130° C. for 20 minutes. Thus, an undercoat layer with a thickness of about 4 μm was provided on the aluminum plate.

[Formation of charge generation layer]

A mixture of the following components was dispersed and pulverized using a ball mill to prepare a coating liquid for charge generation layer:

| | Parts by Weight |
|---|---|
| Bisazo compound with the following formula (b): | 7.5 |

(b)

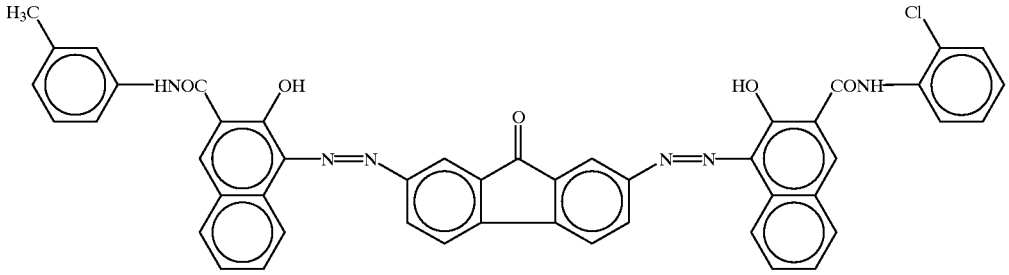

| | |
|---|---|
| Polyester resin (Trademark "Vylon 200", made by Toyobo Co., Ltd.) | 2.5 |
| Tetrahydrofuran | 500 |

The thus obtained coating liquid was coated on the above prepared undercoat layer using a doctor blade with a wet gap being set at about 35 μm, and dried at room temperature, so that a charge generation layer with a thickness of about 3 μm was provided on the undercoat layer.

[Formation of charge transport layer]

The following components were mixed to prepare a coating liquid for charge transport layer:

| | Parts by Weight |
|---|---|
| Charge transport material with the following formula (c): | 7 |

-continued

| | Parts by Weight |
|---|---|
| (c) 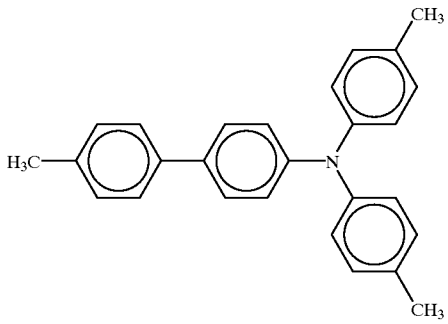 | |
| Polyurethane resin (Resin No. 3) prepared in Preparation Example 6 | 10 |
| Tetrahydrofuran | 100 |

The thus prepared coating liquid was coated on the above prepared charge generation layer using a doctor blade, and dried at 80° C. for 2 minutes, and then 130° C. for 20 minutes, so that a charge transport layer with a thickness of about 25 μm was provided on the charge generation layer.

Thus, an electrophotographic photoconductor No. 4 according to the present invention was fabricated.

EXAMPLE 5

An undercoat layer and a charge generation layer were successively provided on an aluminum plate in the same manner as in Example 4.

[Formation of first charge transport layer]

The following components were mixed to prepare a coating liquid for first charge transport layer:

| | Parts by Weight |
|---|---|
| Charge transport material with the following formula (d): | 7 |
| (d) 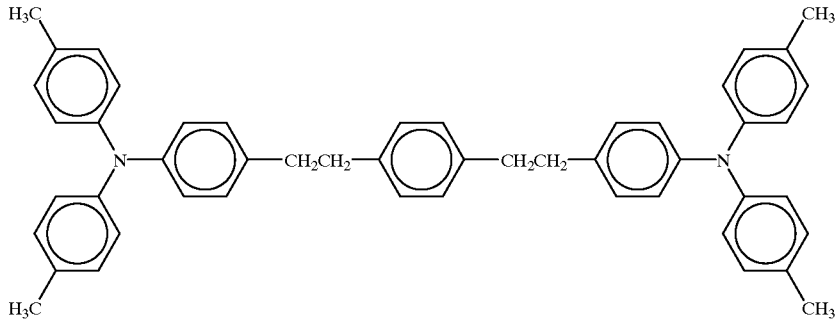 | |
| Polycarbonate resin (Trademark "Panlite C-1400" made by Teijin Limited) | 10 |
| Tetrahydrofuran | 100 |

The thus prepared coating liquid was coated on the above prepared charge generation layer using a doctor blade, and dried at 80° C. for 2 minutes, and then 130° C. for 20 minutes, so that a first charge transport layer with a thickness of about 20 μm was provided on the charge generation layer.

[Formation of second charge transport layer]

The following components were mixed to prepare a coating liquid for second charge transport layer:

| | Parts by Weight |
|---|---|
| Charge transport material with the following formula (d): | 3 |

(d)

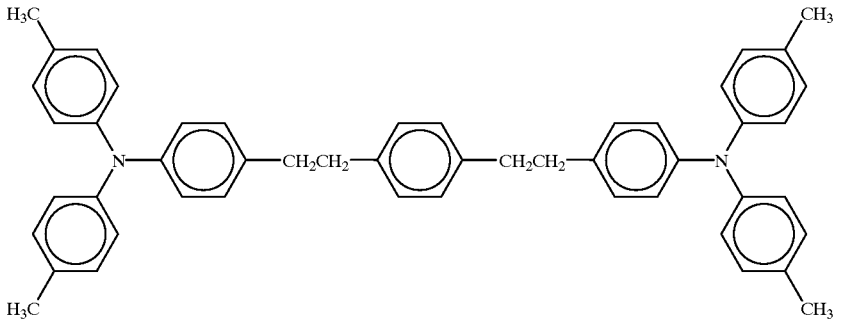

| | |
|---|---|
| Polycarbonate resin having the same repeat unit as in the Resin No. 5 (Mw = 237,700) | 5 |
| Tetrahydrofuran | 40 |
| Cyclohexane | 140 |

The thus prepared coating liquid was coated on the above prepared first charge transport layer using a doctor blade, and dried at 80° C. for 2 minutes, and then 130° C. for 20 minutes, so that a second charge transport layer with a thickness of about 5 μm was provided on the first charge transport layer.

Thus, an electrophotographic photoconductor No. 5 according to the present invention was fabricated.

EXAMPLE 6

The procedure for fabrication of the electrophotographic photoconductor No. 5 in Example 5 was repeated except that the formulation for the second charge transport layer coating liquid used in Example 5 was changed to the following formulation:

<Formulation for second charge transport layer>

| | Parts by Weight |
|---|---|
| Charge transport material with the following formula (e): | 3 |

-continued

| | Parts by Weight |
|---|---|

(e)

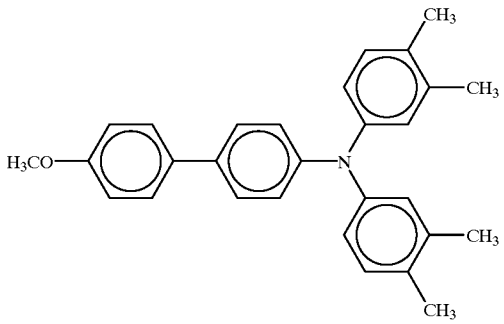

| | |
|---|---|
| Polyester resin (Resin No. 4) prepared in Preparation Example 7 | 5 |
| Finely-divided particles of titanium oxide (Trademark "CR97" made By Ishihara Sangyo Kaisha, Ltd.) | 2 |
| Tetrahydrofuran | 40 |
| Cyclohexane | 140 |

Thus, an electrophotographic photoconductor No. 6 according to the present invention was fabricated.

EXAMPLE 7

An undercoat layer was provided on an aluminum plate in the same manner as in Example 4.

[Formation of charge generation layer]

A mixture of the following components was dispersed and pulverized using a ball mill to prepare a coating liquid for charge generation layer:

| | Parts by Weight |
|---|---|
| Y-type oxotitanium phthalocyanine | 1.5 |
| Polyester resin (Trademark "Vylon 200", made by Toyobo Co., Ltd.) | 1 |
| Dichloromethane | 100 |

The thus obtained coating liquid was coated on the above prepared undercoat layer using a doctor blade with a wet gap being set at about 35 μm, and dried at room temperature, so that a charge generation layer with a thickness of about 3 μm was provided on the undercoat layer.

[Formation of first charge transport layer]

The following components were mixed to prepare a coating liquid for first charge transport layer:

| | Parts by Weight |
|---|---|
| Charge transport material with the following formula (e): | 7 |

-continued

| | Parts by Weight |
|---|---|
| (e) 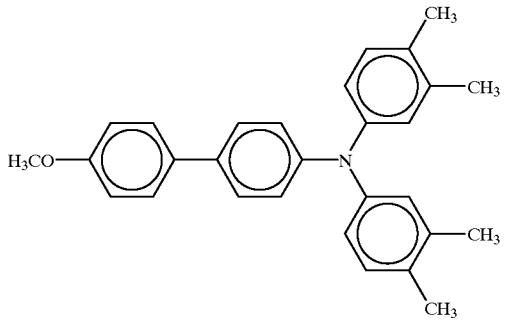 | |
| Polycarbonate resin (Trademark "Panlite C-1400" made by Teijin Limited) | 10 |
| Tetrahydrofuran | 100 |

The thus prepared coating liquid was coated on the above prepared charge generation layer using a doctor blade, and dried at 80° C. for 2 minutes, and then 130° C. for 20 minutes, so that a first charge transport layer with a thickness of about 20 μm was provided on the charge generation layer.

[Formation of second charge transport layer]

The following components were mixed to prepare a coating liquid for second charge transport layer:

| | Parts by Weight |
|---|---|
| Charge transport material with the following formula (e): | 3 |
| (e) 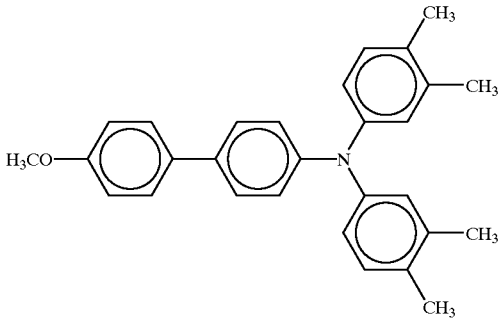 | |
| Polycarbonate resin with the following formula (f) (Mw = 116,300): | 5 |
| (f) 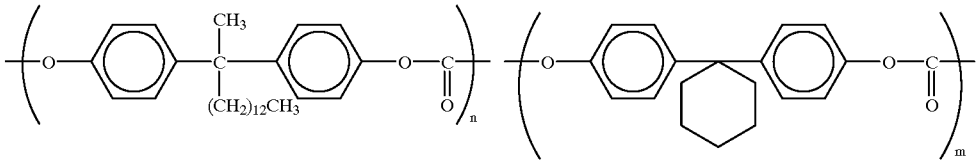 (n:m = 0.5:0.5) | |
| Finely-divided particles of titanium oxide (Trademark "CR97" made | 2 |

-continued

| | Parts by Weight |
|---|---|
| by Ishihara Sangyo Kaisha, Ltd.) | |
| Tetrahydrofuran | 40 |
| Cyclohexane | 140 |

The thus prepared coating liquid was coated on the above prepared first charge transport layer using a doctor blade, and dried at 80° C. for 2 minutes, and then 130° C. for 20 minutes, so that a second charge transport layer with a thickness of about 5 μm was provided on the first charge transport layer.

Thus, an electrophotographic photoconductor No. 7 according to the present invention was fabricated.

REFERENCE EXAMPLE 1

The procedure for fabrication of the electrophotographic photoconductor No. 4 in Example 4 was repeated except that the charge transport material with formula (c) for the charge transport layer coating liquid in Example 4 was replaced by a butadiene compound represented by the following formula (g):

(g)

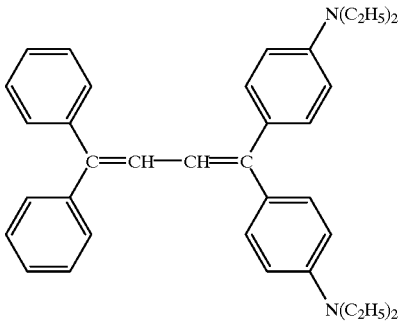

Thus, an electrophotographic photoconductor for reference was fabricated.

REFERENCE EXAMPLE 2

The procedure for fabrication of the electrophotographic photoconductor No. 7 in Example 7 was repeated except that the charge transport material with formula (e) for the first and second charge transport layer coating liquids in Example 7 was replaced by the same butadiene compound of formula (g) as employed in Reference Example 1.

Thus, an electrophotographic photoconductor for reference was fabricated.

[Measurement of Light Transmitting Properties of Charge Transport Layer]

The charge transport layer coating liquids employed in Example 4 and Reference Example 1 were separately applied to the surface of a polyester film to provide a charge transport layer film under the same conditions as indicated in Example 4 or Reference Example 1. Likewise, a two-layered charge transport layer film was individually provided on a polyester film as stated above, using the combination of the first charge transport layer coating liquid and the second charge transport layer coating liquid employed in each of Examples 5 to 7 and Reference Example 2.

A charge transport layer film (or two-layered charge transport layer film) was peeled from the polyester film, and the transmission spectrum of each charge transport layer film was measured using a spectrophotometer. The light transmitting properties at each wavelength was obtained in accordance with the previously mentioned formula (B). The results are shown in TABLE 1.

[Evaluation of Spectral Sensitivity of Photoconductor]

Using a commercially available electrostatic copying sheet testing apparatus "Paper Analyzer Model EPA-8100" (trademark), made by Kawaguchi Electro Works Co., Ltd., the spectral sensitivity of each of the photoconductors fabricated in Examples 4 to 7 and Reference Examples 1 and 2 was measured within a wavelength region from 400 to 450 nm, that is, the shorter wavelength region of the currently available LD or LED.

Each photoconductor was charged negatively to −800 V or more by corona charging, and the charging was stopped. The charged surface of each photoconductor was exposed to monochromatic light of xenon lamp, which was obtained by a commercially available monochromator made by Nikon Corporation. The time required to reduce the initial surface potential, that is, −800 V, to −100 V was measured. The exposure ($\mu J/cm^2$) was calculated from the light intensity ($\mu W/cm^2$). The spectral sensitivity ($V \cdot cm^2/\mu J$) was expressed by dividing the difference in potential by light decay, i.e., 700 V by the above-mentioned exposure. However, the surface potential decreased by dark decay before the light decay in practice. Therefore, a decrease in surface potential by the dark decay was obtained prior to the measurement of the photosensitivity, and the obtained spectral sensitivity was calibrated using the above-mentioned decrease in surface potential by the dark decay. TABLE 1 also shows the results of the measurement of spectral sensitivities.

TABLE 1

| | | Wavelength of Monochromatic Light (nm) | | | | |
|---|---|---|---|---|---|---|
| | | 400 | 420 | 435 | 440 | 450 |
| Ex. 4 | Light transmitting properties (%) | 78 | 83 | 85 | 89 | 90 |
| | Spectral sensitivity ($V \cdot cm^2/\mu J$) | 968 | 1258 | 1320 | 1387 | 1415 |
| Ex. 5 | Light transmitting properties (%) | 76 | 82 | 86 | 88 | 89 |
| | Spectral sensitivity ($V \cdot cm^2/\mu J$) | 798 | 904 | 1030 | 1051 | 1092 |
| Ex. 6 | Light transmitting properties (%) | 77 | 81 | 84 | 87 | 89 |
| | Spectral sensitivity ($V \cdot cm^2/\mu J$) | 865 | 978 | 1112 | 1136 | 1196 |
| Ex. 7 | Light transmitting properties (%) | 42 | 77 | 83 | 84 | 85 |
| | Spectral sensitivity ($V \cdot cm^2/\mu J$) | — | 620 | 1035 | 1126 | 1174 |

TABLE 1-continued

| | | Wavelength of Monochromatic Light (nm) | | | | |
|---|---|---|---|---|---|---|
| | | 400 | 420 | 435 | 440 | 450 |
| Reference Ex. 1 | Light transmitting properties (%) | 0 | 0 | 0 | 0 | 0 |
| | Spectral sensi- | — | — | — | — | — |

TABLE 1-continued

| | | Wavelength of Monochromatic Light (nm) | | | | |
|---|---|---|---|---|---|---|
| | | 400 | 420 | 435 | 440 | 450 |
| | tivity (V · cm$^2$/μJ) | | | | | |
| Reference Ex. 2 | Light transmitting properties (%) | 0 | 0 | 0 | 0 | 0 |
| | Spectral sensitivity (V · cm$^2$/μJ) | — | — | — | — | — |

In TABLE 1, "-" means no sensitivity.

As can be seen from the results of TABLE 1, any charge transport layers of the photoconductors according to the present invention (fabricated in Examples 4 to 7) exhibit excellent light transmission properties throughout the wavelength region of 400 to 450 nm, and therefore, the photoconductors No. 4 to No. 7 show high sensitivity.

In contrast to this, the charge transport layers of the photoconductors fabricated in Reference Examples 1 and 2 do not transmit monochromatic light with wavelengths of 400 to 450 nm. Consequently, these photoconductors show no sensitivity in this wavelength region. The reason for this is that the charge transport material for use in each of the charge transport layers absorbs light with wavelengths of 400 to 450 nm although any of the resins for use in the present invention is contained in the charge transport layer.

COMPARATIVE EXAMPLE 2

The procedure for fabrication of the electrophotographic photoconductor No. 4 in Example 4 was repeated except that the polyurethane resin (Resin No. 3) with a weight average molecular weight of 12,900 for use in the charge transport layer coating liquid in Example 4 was replaced by a commercially available polycarbonate resin "Panlite C-1400" (trademark), made by Teijin Limited.

Thus, a comparative electrophotographic photoconductor No. 2 was fabricated.

COMPARATIVE EXAMPLE 3

The procedure for fabrication of the electrophotographic photoconductor No. 6 in Example 6 was repeated except that the polyester resin (Resin No. 4) for use in the second charge transport layer coating liquid in Example 6 was replaced by a siloxane-copolymerized polycarbonate resin with a weight average molecular weight of 157,800, represented by the following formula (h):

(h)

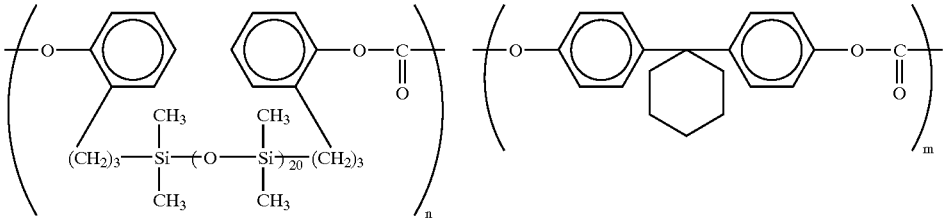

(n:m = 0.3:0.7)

Thus, a comparative electrophotographic photoconductor No. 3 was fabricated.

The photoconductors No. 4 to No. 7 according to the present invention and the comparative photoconductors No. 2 and No. 3 were subjected to an abrasion test. Using a commercially available Taber abrader (made by Toyo Seiki Seisaku-sho, Ltd.) with a truck wheel CS-5, the surface of each photoconductor was abraded by 1,000 rotations at 60 rpm under the application of a load of 1 kg. The decrease in weight of each photoconductor after the abrasion test was regarded as an abrasion loss (mg). The results are shown in TABLE 2.

Further, the contact angle which pure water made with the surface of each photoconductor was measured by a sessile drop method using a commercially available measuring instrument "Automatic Contact Angle Meter CA-W" (trademark), made by KYOWA INTERFACE SCIENCE CO., LTD. In this measurement, the contact angle was measured before and after the above-mentioned abrasion test. In addition, the sliding angle where a droplet of pure water with a volume of 17 μl started sliding down the photoconductor was also measured using the same measuring instrument. Furthermore, the static friction coefficient of the surface of each photoconductor was measured using an automatic friction coefficient measuring apparatus. TABLE 2 also shows these results.

TABLE 2

| | Abrasion | Contact Angle (°) | | Sliding | Static Friction |
|---|---|---|---|---|---|
| | Loss (mg) | Before abrasion | After abrasion | Angle (°) | Coefficient (μS) |
| Ex. 4 | 0.56 | 96 | 92 | 35 | 0.38 |
| Ex. 5 | 0.32 | 101 | 95 | 24 | 0.23 |
| Ex. 6 | 0.05 | 98 | 97 | 54 | 0.33 |
| Ex. 7 | 0.04 | 97 | 97 | 64 | 0.36 |
| Comp. Ex. 2 | 1.98 | 84 | 82 | 88 | 0.45 |

TABLE 2-continued

| | Abrasion | Contact Angle (°) | | Sliding | Static Friction |
|---|---|---|---|---|---|
| | Loss (mg) | Before abrasion | After abrasion | Angle (°) | Coefficient (μS) |
| Comp. Ex. 3 | 1.72 | 95 | 82 | 77 | 0.55 |

As can be seen from the results shown in TABLE 2, the abrasion losses in the photoconductors No. 4 to No. 7 are smaller than those in the comparative photoconductors No. 2 and No. 3. In particular, the abrasion resistance of the photoconductor No. 6 or No. 7 is remarkably improved because a filler is contained in the photoconductive layer.

Furthermore, even after the photoconductors are subjected to the abrasion test, the contact angle which pure water makes with the surface of any of the photoconductors according to the present invention exceeds 90°. This means the surface of the photoconductor maintains excellent water repellency. As mentioned above, the photoconductors of the present invention exhibit excellent mechanical durability, and maintain water repellency for an extended period of time. The sliding angles and the static friction coefficients are smaller in Examples 4 to 7 than in Comparative Examples 2 and 3. In other words, the photoconductors of the present invention show low surface energy.

EXAMPLE 8

The procedure for fabrication of the electrophotographic photoconductor No. 4 in Example 4 was repeated except that the aluminum plate serving as an electroconductive support in Example 4 was replaced by an aluminum cylinder.

Thus, an electrophotographic photoconductor No. 8 according to the present invention was fabricated.

EXAMPLE 9

The procedure for fabrication of the electrophotographic photoconductor No. 6 in Example 6 was repeated except that the aluminum plate serving as an electroconductive support in Example 6 was replaced by an aluminum cylinder.

Thus, an electrophotographic photoconductor No. 9 according to the present invention was fabricated.

REFERENCE EXAMPLE 3

The procedure for fabrication of the electrophotographic photoconductor in Reference Example 1 was repeated except that the aluminum plate serving as an electroconductive support in Reference Example 1 was replaced by an aluminum cylinder.

Thus, an electrophotographic photoconductor for reference was fabricated.

Each of the drum-shaped electrophotographic photoconductors fabricated in Examples 8 and 9 and Reference Example 3 was incorporated in an electrophotographic image forming apparatus with a structure as shown in FIG. 6.

The light exposure unit 13 for use in the apparatus of FIG. 6 adapted a combination of a light source of laser diode (LD) with a wavelength of 405 nm and a polygon mirror. A probe of a potentiometer was inserted into the photoconductor to measure the surface potential of the photoconductor immediately before the development step.

Using the above-mentioned potentiometer, the surface potentials of a non-light-exposed portion and a light-exposed portion on the surface of the photoconductor were measured at the initial stage and after 10,000 copies were continuously made. The results are shown in TABLE 3.

TABLE 3

| | Surface Potential (V) at Initial Stage | | Surface Potential (V) after Making of 10,000 Copies | |
|---|---|---|---|---|
| | Non-light exposed portion | Light-exposed portion | Non-light exposed portion | Light-Exposed Portion |
| Ex. 8 | −815 | −40 | −789 | −52 |
| Ex. 9 | −798 | −52 | −770 | −62 |
| Ref. Ex. 3 | −750 | −80 | −330 | −195 |

As can be seen from the results of TABLE 3, the photoconductors No. 8 and No. 9 according to the present invention show excellent durability on the grounds that the changes in surface potentials are very small after making of 10,000 copies.

With respect to the photoconductor fabricated in Reference Example 3, the charge transport material shows signs of fatigue caused by repeated exposure to a light source with a wavelength of 405 nm although any of the resins for use in the present invention is contained in the charge transport layer. As a result, a decrease in charging characteristics and an increase in residual potential are observed after making of 10,000 copies.

EXAMPLE 10

<Fabrication of Photoconductor No. 10>

[Formation of undercoat layer]

The following components were mixed to prepare a coating liquid for undercoat layer:

| | Parts by Weight |
|---|---|
| Titanium dioxide (Trademark "TA-300", made by Ishihara Sangyo Kaisha, Ltd.) | 5 |
| Copolymer polyamide resin (Trademark "CM-8000", made by Toray Industries, Inc.) | 4 |
| Methanol | 50 |
| Isopropanol | 20 |

The thus prepared coating liquid was coated on an outer surface of an electromolded nickel endless belt and dried to provide an undercoat layer with a thickness of about 6 μm on the nickel belt.

[Formation of charge generation layer]

The following components were mixed to prepare a coating liquid for charge generation layer:

| | Parts by Weight |
|---|---|
| Y-type oxotitanium phthalocyanine pigment powder | 4 |
| Poly(vinyl butyral) | 2 |

-continued

| | Parts by Weight |
|---|---|
| Cyclohexanone | 50 |
| Tetrahydrofuran | 100 |

The thus obtained coating liquid was coated on the above prepared undercoat layer and dried to provide a charge generation layer with a thickness of about 0.3 μm on the undercoat layer.

[Formation of first charge transport layer]

The following components were mixed to prepare a coating liquid for first charge transport layer:

| | Parts by Weight |
|---|---|
| Charge transport material with the following formula (e): | 7 |

-continued

| | Parts by Weight |
|---|---|
| (e) 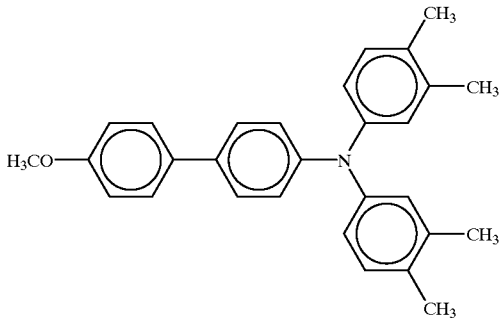 | |
| Polycarbonate resin (Trademark "Panlite C-1400" made by Teijin Limited) | 10 |
| Tetrahydrofuran | 150 |

The thus prepared coating liquid was coated on the above prepared charge generation layer and dried to provide a first charge transport layer with a thickness of 24 μm on the charge generation layer.

[Formation of second charge transport layer]

The following components were mixed to prepare a coating liquid for second charge transport layer:

| | Parts by Weight |
|---|---|
| Charge transport material with the following formula (e): | 0.45 |

(e)

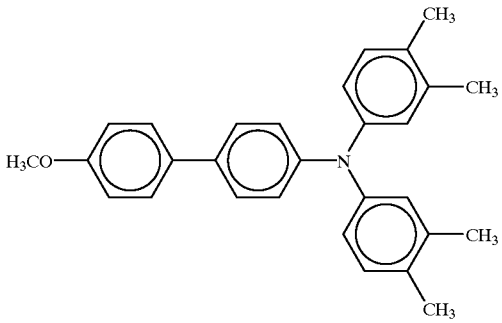

-continued

| | Parts by Weight |
|---|---|
| Polycarbonate resin with the following formula (i) (Mw = 198,700): | 0.75 |
| Finely-divided particles of titanium oxide (Trademark "CR97" made by Ishihara Sangyo Kaisha, Ltd.) | 0.3 |
| Dichloromethane | 45 |

(i)

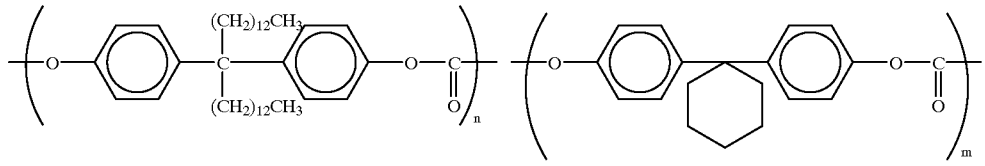

(n:m = 0.5:0.5)

The thus prepared coating liquid was coated on the above prepared first charge transport layer and dried to provide a second charge transport layer with a thickness of 4 $\mu$m on the first charge transport layer.

Thus, an electrophotographic photoconductor No. 10 according to the present invention was fabricated.

The belt-shaped electrophotographic photoconductor No. 10 fabricated in Example 10 was incorporated in an electrophotographic image forming apparatus with a structure as shown in FIG. 7.

The light exposure unit 24 for use in the apparatus of FIG. 7 adapted a combination of a light source of semiconductor laser with a wavelength of 450 nm and a polygon mirror. The pre-cleaning light 26 as shown in FIG. 7 was omitted. A probe of a potentiometer was inserted into the photoconductor to measure the surface potential of the photoconductor immediately before the development step.

Using the above-mentioned potentiometer, the surface potentials of a non-light-exposed portion and a light-exposed portion on the surface of the photoconductor were measured at the initial stage and after 8,000 copies were continuously made. The results are shown in TABLE 4.

TABLE 4

| | Surface Potential (V) at Initial Stage | | Surface Potential (V) after Making of 8,000 Copies | |
|---|---|---|---|---|
| | Non-light exposed portion | Light-exposed portion | Non-light Exposed Portion | Light exposed portion |
| Ex. 10 | −820 | −45 | −802 | −59 |

EXAMPLE 11

<Fabrication of Photoconductor No. 11>

[Formation of undercoat layer]

An outer surface of an aluminum cylinder was subjected to anodizing, followed by sealing, whereby an undercoat layer was provided on the outer surface of the aluminum cylinder.

[Formation of charge generation layer]

The following components were mixed to prepare a coating liquid for charge generation layer:

| | Parts by Weight |
|---|---|
| τ-type metal-free phthalocyanine pigment powder | 3 |
| Bisazo compound of formula (b) | 3 |
| Poly(vinyl butyral) (Trademark "BM-S", made by Sekisui | 1 |

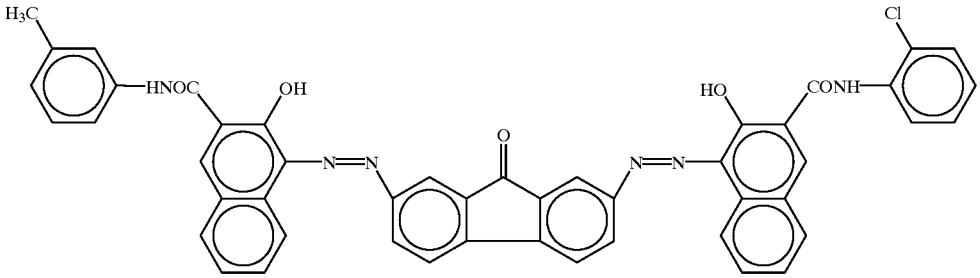

(b)

-continued

| | Parts by Weight |
|---|---|
| Chemical Co., Ltd.) | |
| Cyclohexanone | 250 |
| Methyl ethyl ketone | 50 |

The thus obtained coating liquid was coated on the above prepared undercoat layer and dried to provide a charge generation layer with a thickness of 0.2 μm on the undercoat layer.

[Formation of first charge transport layer]

The following components were mixed to prepare a coating liquid for first charge transport layer:

| | Parts by Weight |
|---|---|
| Charge transport material with the following formula (e): | 7 |
| Polycarbonate resin (Trademark "Panlite C-1400" made by | 10 |

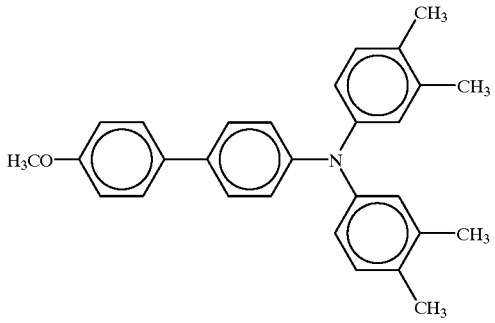

(e)

-continued

| | Parts by Weight |
|---|---|
| Teijin Limited) | |
| Tetrahydrofuran | 150 |

The thus prepared coating liquid was coated on the above prepared charge generation layer and dried to provide a first charge transport layer with a thickness of 20 μm on the charge generation layer.

[Formation of second charge transport layer]

The following components were mixed to prepare a coating liquid for second charge transport layer:

| | Parts by Weight |
|---|---|
| Charge transport material with the following formula (e): | 7 |
| Polycarbonate resin with the following formula (j) (Mw = 183,700): | 10 |

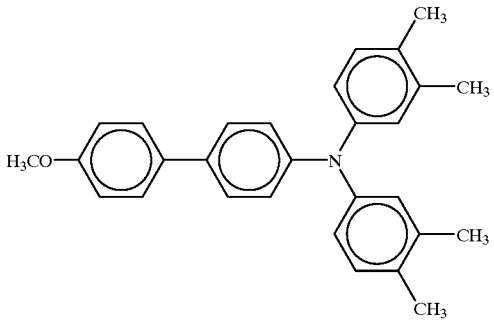

(e)

-continued

| | Parts by Weight |
|---|---|
| 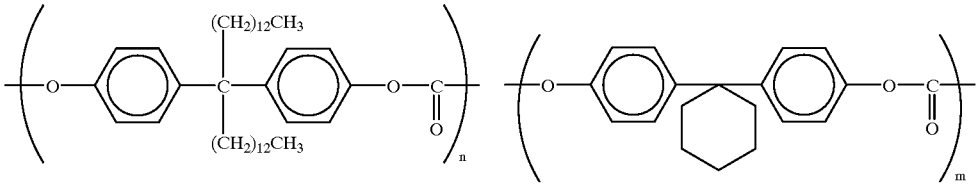 (j) (n:m = 0.15:0.85) | |
| Finely-divided particles of alumina (Trademark "Alumina-C" made by Nippon Aerosil Co., Ltd.) | 4 |
| Dichloromethane | 80 |

The thus prepared coating liquid was coated on the above prepared first charge transport layer and dried to provide a second charge transport layer with a thickness of 5 μm on the first charge transport layer.

Thus, an electrophotographic photoconductor No. 11 according to the present invention was fabricated.

The drum-shaped electrophotographic photoconductor No. 11 fabricated in Example 11 was incorporated in an electrophotographic image forming process cartridge with a structure as shown in FIG. 8, and the process cartridge was set in an image forming apparatus.

The light exposure unit 32 for use in the process cartridge of FIG. 8 adapted a combination of a light source of semiconductor laser with a wavelength of 435 nm and a polygon mirror. A probe of a potentiometer was inserted into the photoconductor to measure the surface potential of the photoconductor immediately before the development step.

Using the above-mentioned potentiometer, the surface potentials of a non-light-exposed portion and a light-exposed portion on the surface of the photoconductor were measured at the initial stage and after 5,000 copies were continuously made. The results are shown in TABLE 5.

TABLE 5

| | Surface Potential (V) at Initial Stage | | Surface Potential (V) after Making of 5,000 Copies | |
|---|---|---|---|---|
| | Non-light exposed portion | Light-exposed portion | Non-light Exposed Portion | Light exposed portion |
| Ex. 11 | −812 | −29 | −804 | −35 |

Furthermore, a tester for image formation was constructed, using each of the photoconductors No. 8 to No. 11, a charging roller as charging means, an optical system as light exposure means, employing a light source of semiconductor laser with a wavelength of 405 nm, with the beam size thereof being adjusted by an aperture, a development unit as development means, employing a two-component developer, and a pattern generator.

Individual dot images were produced on the surface of each photoconductor, with the beam size of the optical system being set to 30 μm. The dot images were transferred to an adhesive tape and analyzed using a CCD camera. For the above-mentioned image formation, the photoconductor was initially charged to 600 V. The two-component developer comprising a magnetic toner with a mean particle diameter of 6 μm was employed. The shape and reproducibility of the dot images were visually inspected. It was confirmed that the dot images were reproduced with high contrast in any case.

Japanese Patent Application No. 2000-083304 filed Mar. 24, 2000, Japanese Patent Application No. 2000-323941 filed Oct. 24, 2000, and Japanese Patent Application No. 2001-047310 filed Feb. 22, 2001 are hereby incorporated by reference.

What is claimed is:

1. An electrophotographic photoconductor comprising:

an electroconductive support and a photoconductive layer which is formed on said electroconductive support and comprises at least one resin selected from the group consisting of a polyurethane resin and a polyester resin, each of said resins comprising at least a structural unit represented by formula (1):

(1)

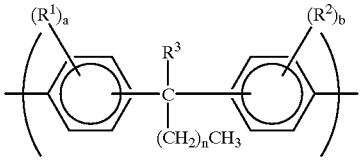

wherein $R^1$ and $R^2$ are each a halogen atom, a substituted or unsubstituted alkyl group having 1 to 6 carbon atoms, a substituted or unsubstituted alkoyxl group having 1 to 6 carbon atoms, or a substituted or unsubstituted aryl group; $R^3$ is a substituted or unsubstituted alkyl group having 1 to 6 carbon atoms or an alkyl group represented by $—(CH_2)_m CH_3$; a and b are each an integer of 0 to 4, and when a and b are each an integer of 2 to 4, a plurality of groups represented by $R^1$ or $R^2$ may be the same or different; and n and m are each an integer of 8 to 27; and wherein said photoconductive layer comprises a charge generation layer comprising a charge generation material and a charge transport layer comprising a charge transport material and at least one said resin, with said charge generation layer and said charge transport layer being successively overlaid on said electroconductive support in this order.

2. The photoconductor as claimed in claim 1, wherein said charge transport layer further comprises a first charge transport layer comprising said charge transport material and a second charge transport layer comprising said charge transport material and at least said one resin, with said first charge transport layer and said second charge transport layer being successively overlaid on said charge generation layer in this order.

3. The photoconductor as claimed in claim 2, wherein said second charge transport layer further comprises a filler.

4. The photoconductor as claimed in claim 2, wherein a contact angle which pure water makes with a surface of said second charge transport layer is in a range of 85 to 140°.

5. The photoconductor as claimed in claim 4, wherein said contact angle is in a range of 85 to 140° after said surface of said second charge transport layer is abraded by 1±0.3 μm.

6. The photoconductor as claimed in claim 2, wherein a sliding angle at which pure water starts sliding down a surface of said second charge transport layer is in a range of 5 to 65°.

7. The photoconductor as claimed in claim 1, wherein said charge transport layer transmits a monochromatic light with a wavelength in a range of 390 to 460 nm.

8. The photoconductor as claimed in claim 7, wherein said charge transport layer shows light transmitting properties of 50% or more with respect to said monochromatic light.

9. The photoconductor as claimed in claim 1, wherein said photoconductive layer further comprises a filler.

10. The photoconductor as claimed in claim 1, wherein said filler is selected from the group consisting of titanium oxide, tin oxide, zinc oxide, zirconium oxide, indium oxide, silicon nitride, calcium oxide, barium sulfate, silica, colloidal silica, alumina, carbon black, fluorine-containing resin powder, polysiloxane resin powder, polyethylene resin powder, and grafted copolymer with a core shell structure.

11. The photoconductor as claimed in claim 1, wherein said charge transport layer further comprises a filler.

12. The photoconductor as claimed in claim 1, wherein a contact angle which pure water makes with a surface of said photoconductive layer is in a range of 85 to 140°.

13. The photoconductor as claimed in claim 12, wherein said contact angle is in a range of 85 to 140° after said surface of said photoconductive layer is abraded by 1±0.3 μm.

14. The photoconductor as claimed in claim 1, wherein a contact angle which pure water makes with a surface of said charge transport layer is in a range of 85 to 140°.

15. The photoconductor as claimed in claim 14, wherein said contact angle is in a range of 85 to 140° after said surface of said charge transport layer is abraded by 1±0.3 μm.

16. The photoconductor as claimed in claim 1, wherein a sliding angle at which pure water starts sliding down a surface of said photoconductive layer is in a range of 5 to 65°.

17. The photoconductor as claimed in claim 1, wherein a sliding angle at which pure water starts sliding down a surface of said charge transport layer is in a range of 5 to 65°.

* * * * *